US011626666B2

(12) United States Patent
Hou et al.

(10) Patent No.: US 11,626,666 B2
(45) Date of Patent: Apr. 11, 2023

(54) INTEGRATED POLARIZATION CONVERTER AND FEED HORN

(71) Applicant: HUGHES NETWORK SYSTEMS LLC, Germantown, MD (US)

(72) Inventors: Peter Hou, Gaithersburg, MD (US); Junyu Shen, Germantown, MD (US); George Eapen, Boyds, MD (US); Kunj Desai, Clarksburg, MD (US); Peter Mclaren, Bowie, MD (US)

(73) Assignee: Hughes Network Systems, LLC, Germantown, MD (US)

( * ) Notice: Subject to any disclaimer, the term of this patent is extended or adjusted under 35 U.S.C. 154(b) by 0 days.

(21) Appl. No.: 17/390,686

(22) Filed: Jul. 30, 2021

(65) Prior Publication Data

US 2022/0037793 A1 Feb. 3, 2022

Related U.S. Application Data

(60) Provisional application No. 63/059,949, filed on Jul. 31, 2020.

(51) Int. Cl.
*H01Q 13/02* (2006.01)

(52) U.S. Cl.
CPC ..... *H01Q 13/0241* (2013.01); *H01Q 13/0283* (2013.01)

(58) Field of Classification Search
CPC ..... H01Q 13/0241; H01Q 13/0283; H01Q 13/0258; H01Q 13/02; H01Q 15/244; H01Q 15/246
See application file for complete search history.

(56) References Cited

U.S. PATENT DOCUMENTS

| | | | | |
|---|---|---|---|---|
| 3,955,202 A * | 5/1976 | Young | H01Q 13/0241 343/756 |
| 5,398,010 A | 3/1995 | Klebe | |
| 2002/0021256 A1 | 2/2002 | Yuanzhu | |
| 2005/0200548 A1* | 9/2005 | Fusco | H01Q 13/0241 343/786 |

FOREIGN PATENT DOCUMENTS

| | | | | |
|---|---|---|---|---|
| CN | 112582801 A * | 3/2021 | H01P 1/16 |
| JP | 2003124735 A | 4/2003 | |
| JP | 2003347801 A | 12/2003 | |

OTHER PUBLICATIONS

International Search Report and Written Opinion dated Nov. 4, 2021 in corresponding PCT/US2021/044065.

* cited by examiner

*Primary Examiner* — Hoang V Nguyen
(74) *Attorney, Agent, or Firm* — NovoTechIP International PLLC

(57) ABSTRACT

An integral waveguide device herein includes a polarizer component comprising a waveguide and a dielectric slab, the dielectric slab configured to change a polarization of a signal passing through the waveguide. The integral waveguide device also includes a feed horn for conveying signals between the waveguide and a parabolic antenna. The waveguide of the polarizer and the feed horn are manufactured as an integral component with the feed horn disposed at a first end of the waveguide.

19 Claims, 28 Drawing Sheets

700

INTEGRATED POLARIZATION CONVERTER AND FEED HORN

CROSS-REFERENCE TO RELATED APPLICATIONS

This application claims the benefit of priority from U.S. Provisional Patent Application Ser. No. 63/059,949, filed on Jul. 31, 2020, and entitled "Integrated Polarization Converted and Feed Horn."

BACKGROUND

Currently the feed horn and the polarizer (also referred to herein as a "polarization converter") for very-small-aperture terminals (VSATs) are designed and manufactured as separate components. Typically, the polarizer itself is manufactured as two separate pieces as split diecast halves. The intricate nature of the internal structure of the polarizer prevents the polarizer from being die-cast as a single piece. The two halves must then be carefully and very precisely assembled to form the polarizer Hence, there are significant areas for new and improved mechanisms for manufacturing the polarizer and the feed horn for use in VSATs and other such communication devices.

SUMMARY

An integral waveguide device according to the disclosure includes a polarizer component comprising a waveguide and a dielectric slab, the dielectric slab configured to change a polarization of a signal passing through the waveguide; and a feed horn for conveying signals between the waveguide and a parabolic antenna, wherein the waveguide of the polarizer and the feed horn are manufactured as an integral component with the feed horn disposed at a first end of the waveguide.

An example method for manufacturing an integral waveguide according to the disclosure includes forming the integral waveguide in a single piece, the integral waveguide comprising a waveguide of a polarizer element and a feed horn, the feed horn disposed at a first end of the waveguide; and inserting the dielectric slab into the waveguide of the polarizer, the dielectric slab configured to change a polarization of a signal passing through the waveguide.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

BRIEF DESCRIPTION OF THE DRAWINGS

The drawing figures depict one or more implementations in accord with the present teachings, by way of example only, not by way of limitation. In the figures, like reference numerals refer to the same or similar elements. Furthermore, it should be understood that the drawings are not necessarily to scale.

DETAILED DESCRIPTION

Figure 1:
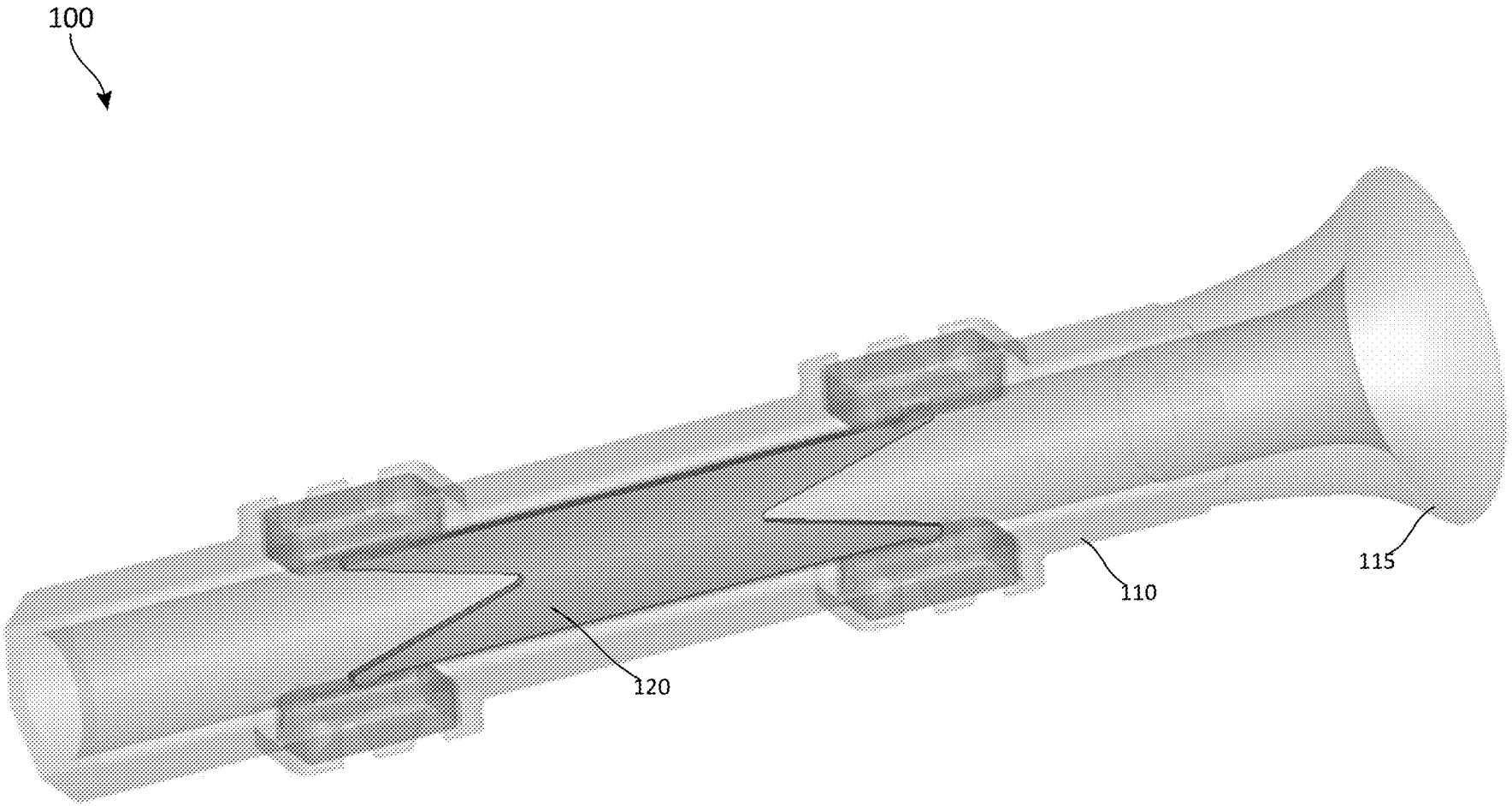
FIG. 1 is a diagram showing an example integrated feed horn and polarizer.

In the following detailed description, numerous specific details are set forth by way of examples in order to provide a thorough understanding of the relevant teachings. However, it should be apparent that the present teachings may be practiced without such details. In other instances, well known methods, procedures, components, and/or circuitry have been described at a relatively high-level, without detail, in order to avoid unnecessarily obscuring aspects of the present teachings.

Techniques are described herein for manufacturing, assembling, using, and tuning an integrated feed horn and polarizer. These techniques solve the technical problems associated with multipart feed horns and polarizers by providing an integrated feed horn and polarizer that are manufactured as a single piece. A technical benefit of these techniques is that these techniques facilitate optimization of key performance parameters during the manufacturing process, such as but not limited to cross-polarization and impedance matching, which impact the operating bandwidth of a device using the integrated feed horn and polarizer. Current approaches include designing the feed horn and the polarizer separately. These and other key performance parameters are optimized separately for the feed horn and the polarizer but are not necessarily optimal when the feed horn and the polarizer are combined. The performance issues resulting from this separate design approach may significantly limit the operating bandwidth of the VSAT or other device using a feed horn and polarizer that have been separately manufactured and optimized. The techniques provided herein provide a technical solution to these problems and meets the rapidly increasing demand for higher operating bandwidth resulting from the proliferation of consumer broadband Internet via satellite system.

A second technical benefit of the techniques provided herein addresses another significant shortcoming of current manufacturing and assembly of the multipart feed horn and polarizer systems. The polarizer and the feed horn in such systems are typically fastened together using bolts and nuts with the assistance of alignment pin and alignment hole pairs. However, this technique to connect the polarizer and the feed horn is susceptible to mechanical misalignment and microscopic gaps between the polarizer and the feed horn. Such misalignment and/or gaps may further degrade the assembly's cross-polarization and return loss, and in severe cases, result in the leakage of radiofrequency (RF) energy. The operating frequency of the VSATs and other similar devices has also moved toward higher frequencies, which may further exacerbate these problems due to the increased precision required as wavelengths decrease. Another benefit provided by the techniques disclosed herein is that these techniques may also significantly reduce the cost of manufacturing the feed horn and polarizer. The manufacture of the integral feed horn and polarizer eliminates the additional labor required to connect the separate pieces of the feedhorn and/or polarizer, and thus, may significantly reduce the cost of manufacturing the feedhorn and polarizer. These and other technical benefits of the techniques disclosed herein will be evident from the discussion of the example implementations that follow.

FIG. 1 is a diagram showing an example integrated feed horn and polarizer 100. The integrated feed horn and polarizer 100 includes a polarizer 110 and feed horn 135 that are manufactured as a single piece. The integrated feed horn and polarizer 100 includes a dielectric slab 120 that may be inserted into the integrated feed horn and polarizer 100 after the integrated polarizer 110 and feed horn 135 are manufactured.

The feed horn 135 is a horn antenna coupled to the polarizer 110 of the integrated feed horn and polarizer 100. The feed horn 135 may be used to couple the polarizer 110 to an antenna, such as but not limited to an offset dish antenna or a parabolic dish antenna. In the various examples shown in the figures, the feed horn is a circular horn. However, the other types of feed horns may also be used, including but not limited to corrugated circular horns or quad-ridged circular horns.

The integrated feed horn and polarizer 100 may be manufactured using various machining techniques. In some implementations, the integrated feed horn and polarizer 100 may be machined using an extrusion process. In some implementations, the integrated feed horn and polarizer 100 may include a symmetric cross section that may be suitable for manufacturing using a lathe. Some implementations may also be suitable for one-piece diecasting, which is one of the lowest-cost manufacturing methods that may be used for mass production. The integrated feed horn and polarizer 100 may be manufacturing using a Computer Numerical Control (CNC) lathe which can produce parts with extreme accuracy and precision and requires little manual involvement by a human operator. Further savings on manufacturing costs may also be incurred by eliminating the need for precisely assembling multiple parts required by the current approaches for manufacturing these components. The integrated feed horn and polarizer 100 may also have a more compact form factor that the multipart feed horn and polarizer combinations currently used, which may consume less raw materials than other manufacturing methods and thus further reduce manufacturing costs.

The feed horn 135 and polarizer 110 of the integrated feed horn and polarizer 100 are optimized to work together as a system. This approach provides significant improvements in RF performance over systems in which a separate polarizer and a feed horn are connected. In particular, the integrated feed horn and polarizer provide improved performance in terms of axial ratio (or equivalently lower cross-polarization), impedance matching (as expressed in return loss), and operating bandwidth.

The integrated feed horn and polarizer 100 also eliminates the interface between the separate polarizer and feed horn. The interface between the separate polarizer and feed horn may result in degraded RF performance and/or RF leakage. The integrated feed horn and polarizer 100 is not subject to these performance problems, because the interface between these elements has been eliminated.

Figure 2:
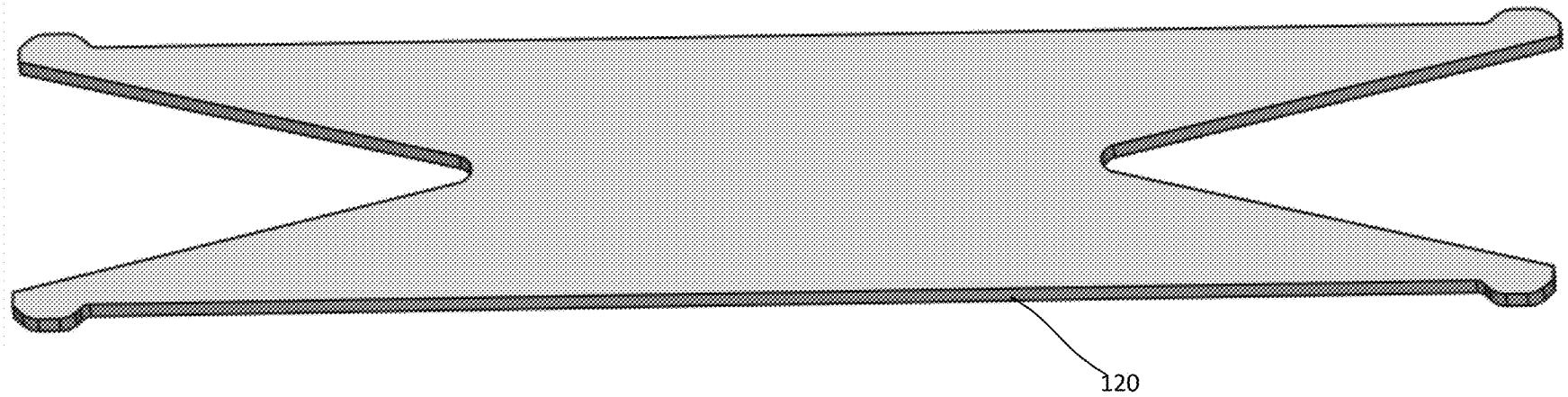
FIG. 2 is a diagram showing additional details of an example dielectric slab that may be used with the integrated feed horn and polarizer shown in FIG. 1.

The dielectric slab 120 is disposed within a void alone the axial length of the polarizer 110 that serves as a waveguide for the integrated feed horn and polarizer 100. In the example shown in FIG. 1, the void is tubular void having a round cross-section. The dielectric slab 120 may be formed from a plastic material and inserted into the integrated feed horn and polarizer 100 after the integrated feed horn and polarizer 100 has been manufactured. As will be discussed in the examples which follow, the dielectric slab 120 may be anchored to the integrated feed horn and polarizer 100 using various techniques. Furthermore, the length of the dielectric slab 120 may be adjusted to allow for fine tuning of the electrical properties of the integrated feed horn and polarizer 100. FIG. 2 shows additional details of the dielectric slab 120. The dielectric slab 120 may be implemented using a printed circuit substrate, such as but not limited to Rogers RO5880.

The use of such a dielectric slab 120 in the integrated feed horn and polarizer 100 permits the design of the waveguide portion of the integrated feed horn and polarizer 100 to be kept as simple as possible to facilitate the manufacture of the integrated feed horn and polarizer 100 as a single unit. The smooth and symmetrical void along the central axis of the waveguide is particularly suitable for manufacturing through diecasting or the use of a lathe. Many of the currently used polarizers include internal corrugations that serve to polarize received and/or transmitted signals. For example, internal corrugations in the waveguide may convert an incoming wave from linear to circular polarization. However, such internal corrugations are suited to the diecasting or lathing of an integral waveguide, and thus, are formed of multiple pieces which then must be accurately and precisely assembled.

The feed horn 135 may be used to couple the polarizer 110 to an antenna of a VSAT. A VSAT is a two-way satellite ground station with a dish antenna and a feed arm. The integrated feed horn and polarizer 100 may be mounted on the distal of the feed arm and is typically positioned such that the phase center of the feed horn is disposed at the focal point of the dish antenna.

VSATs may be used to transmit narrowband data and/or broadband data. For example, a VSAT may be used to transmit narrowband data associated with point-of-sale transactions, supervisory control and data acquisition (SCADA) data for control systems for supervising high-level processes, and/or for polling and/or RF identification (RFID) data. A VSAT may also be used to provide broadband data access to remote location, including streaming video content and/or voice-over-IP (VoIP) services. VSATs may also be used in mobile installations and/or for mobile maritime communications. The VSATs may include one or more controllers, processor, and/or other computing elements (not shown) configured to support the transmission and/or receiving of data via the VSAT.

The form factor of the integrated feed horn and polarizer 100 may provide a significant technical benefit when used in a VSAT. The integrated feed horn and polarizer 100 may have significantly more compact form factor than a separate feed horn and polarizer that have been coupled together. In a center fed VSAT, a more compact transceiver reduces the blockage of the antenna beam by the transceiver resulting in a higher antenna gain.

Figure 3:
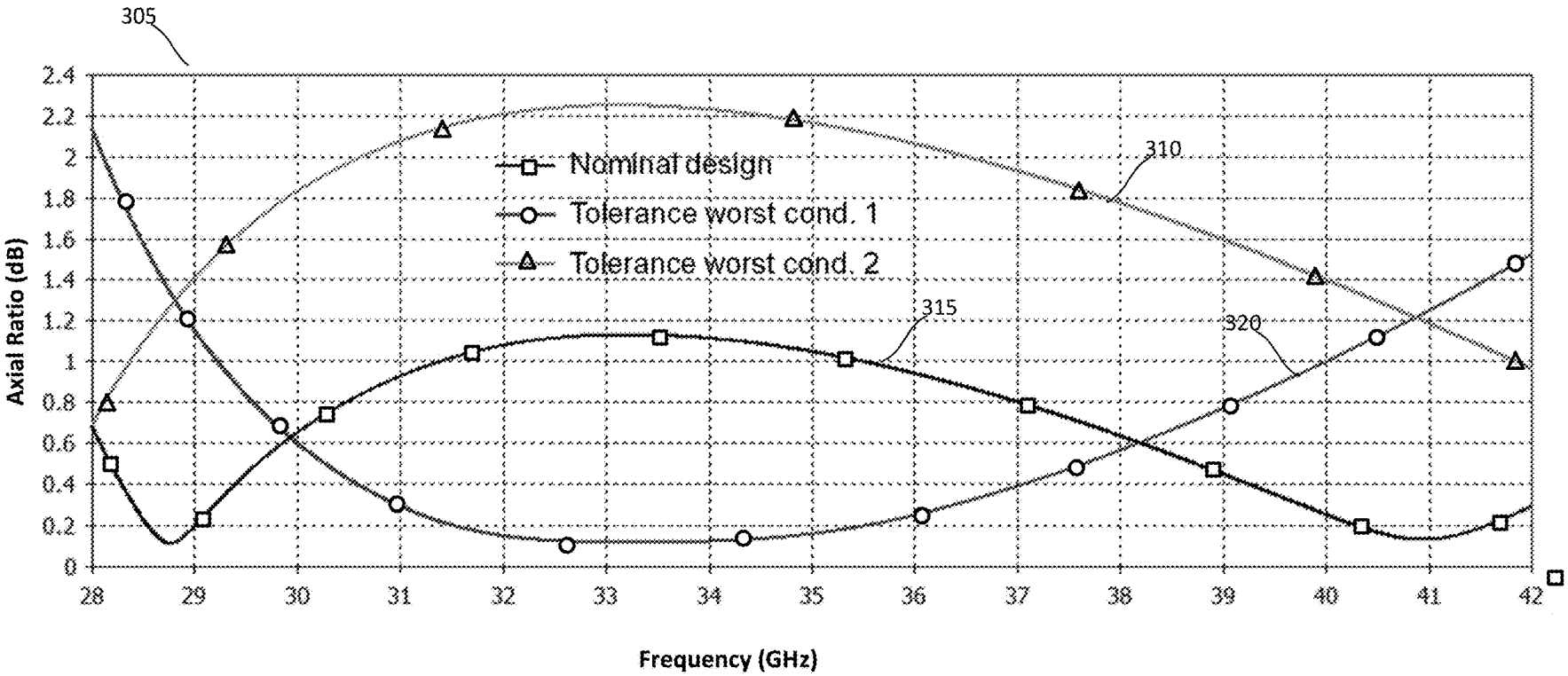
FIG. 3 is a chart showing simulated performance of the integrated feed horn and polarizer shown in FIG. 1.

FIG. 3 is a chart 305 showing simulated performance of the integrated feed horn and polarizer 100 shown in FIG. 1. The x-axis or horizontal axis of the chart 305 represents the frequency in gigahertz (GHz) of a signal, and the y-axis or vertical axis of the chart 305 represents the axial ratio in decibels (dB). The axial ratio represents a deviation of an antenna using the integrated feed horn and polarizer 100 from an ideal case of circular polarization over a specified angular range. The chart includes three plots 310, 315, and 320. The plot 315 represents a nominal design of the integrated feed horn and polarizer 100 used for a particular implementation. Manufacturing tolerances when manufacturing the integrated feed horn and polarizer 100 may impact the axial ratio. The plot 310 shows an impact of a first worst case set of tolerance conditions and the impact on the axial ratio. The plot 320 shown an impact of a second worst case set of tolerance conditions and the impact on the axial ratio.

FIGS. 4A, 4B, 4C, 4D, 4E, 4F, and 4G are diagrams showing views of an example integrated horn and polarizer 400 from different angles to show details of the device. The integrated horn and polarizer 400 may be used to implement the integrated horn and polarizer 100 shown in the preceding examples.

Figure 4A:
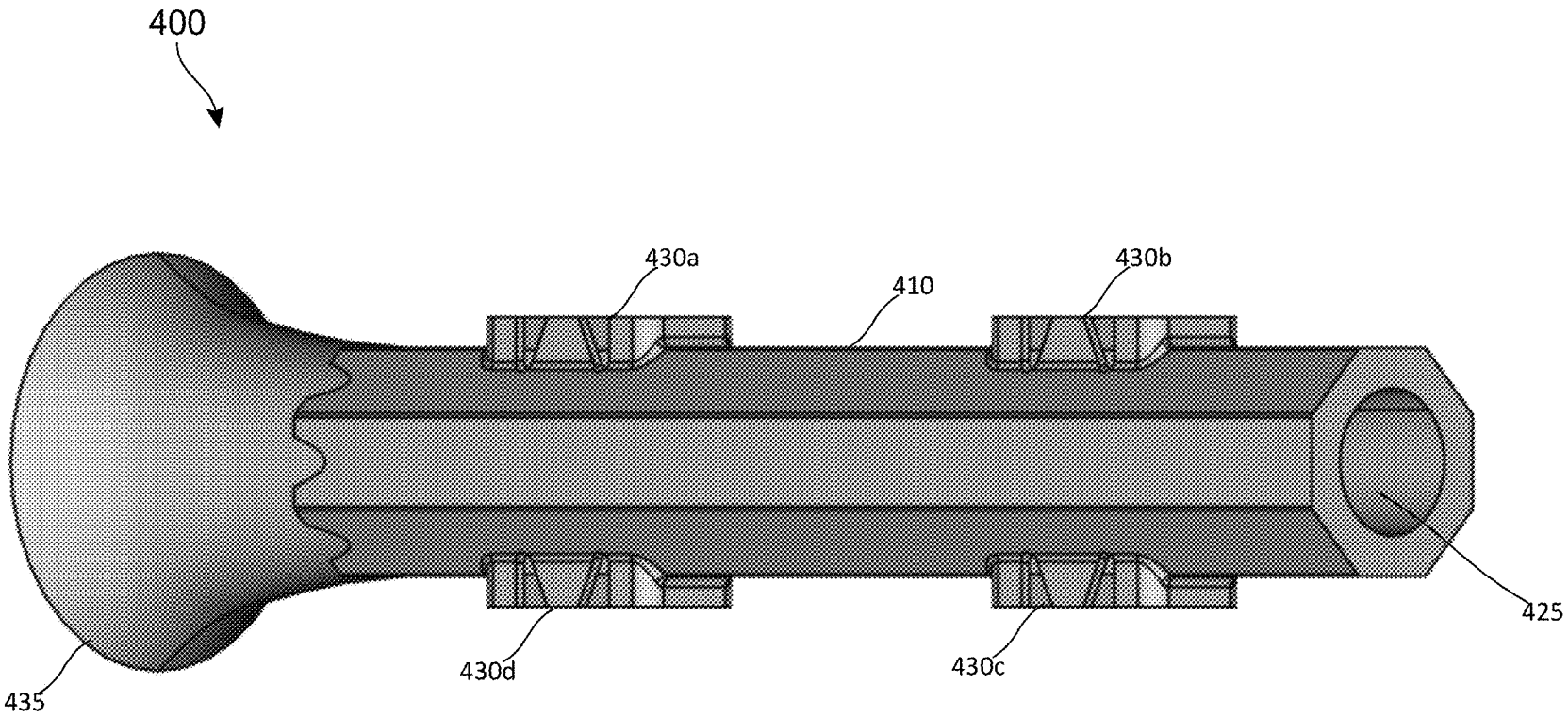
FIGS. 4A, 4B, 4C, 4D, 4E, and 4F are diagrams showing views of an example integrated horn and polarizer according to the techniques provided herein.
Figure 8A:
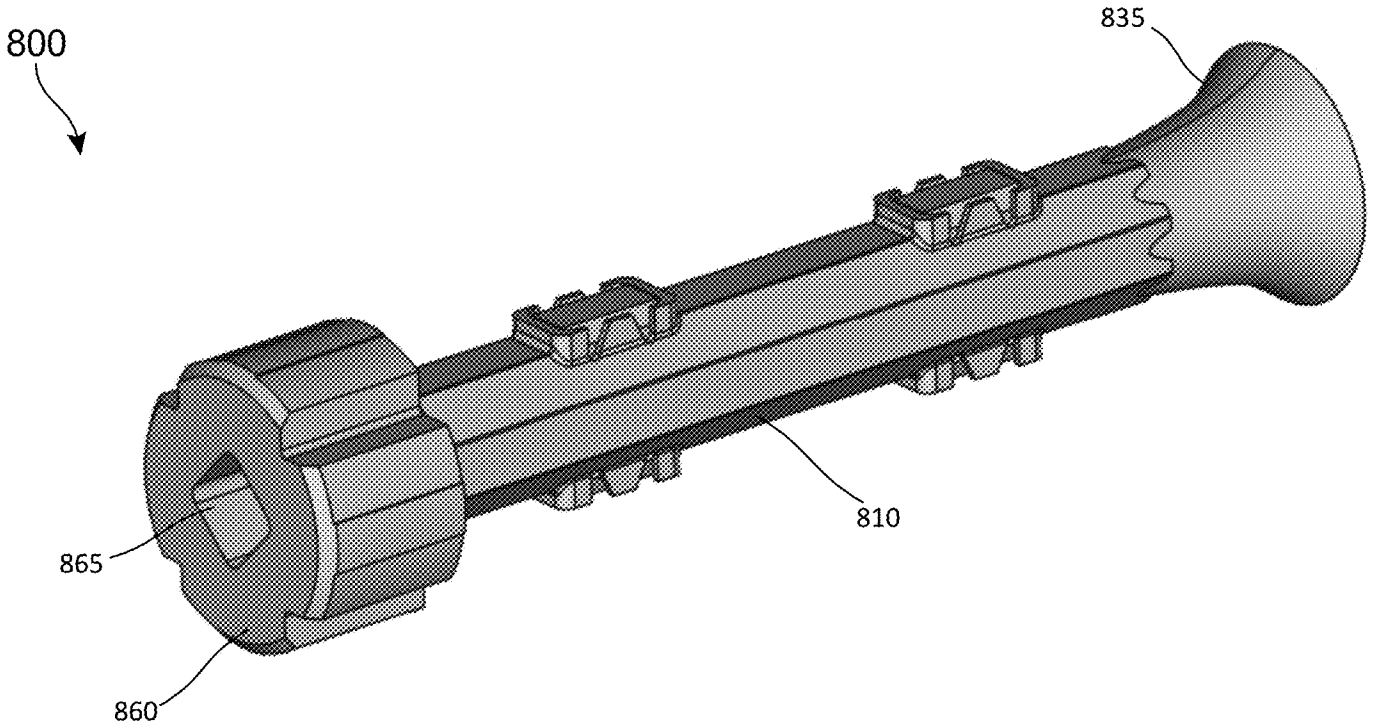
FIGS. 8A and 8B are diagrams showing an example of an integrated feed horn and polarizer that includes an adaptor or connector for coupling the integrated feed horn and polarizer to a port of a device.
Figure 8B:
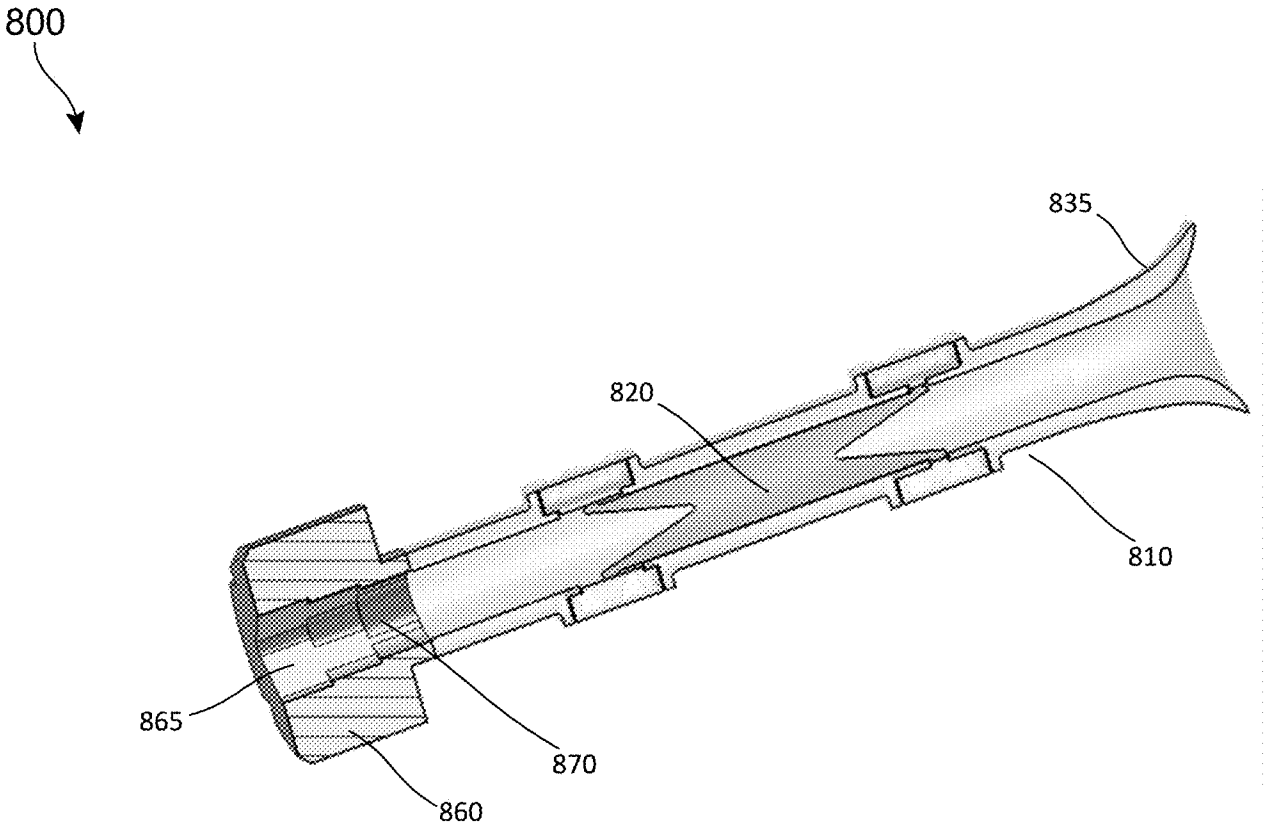

FIG. 4A shows a first view of the integrated horn and polarizer 400. The integrated horn and polarizer 400 includes a feed horn 435 and a polarizer 410. The polarizer 410 comprises a waveguide in which a dielectric slab 420 is inserted. The dielectric slab 420 is visible in FIGS. 4F and 4G. The port 425 is visible in FIG. 4A. The port 425 may be used to mount the integrated horn and polarizer 400 onto a communication system with which the integrated horn and polarizer 400 is to be utilized. In implementations where the integrated horn and polarizer 400 is to be utilized with a VSAT, the port 425 may be used to connect the integrated horn and polarizer 400 to an orthomode transducer (OMT), which is a waveguide component that may also be referred to as a polarization duplexer. In a typical VSAT configuration, the transmit and receive signals are orthogonally polarized with respect to each other. The OMT may be used to isolate orthogonal polarizations of a signal and transfer the transmit and receive signals to different ports. In some implementations, the port 425 may be connected with an adaptor or connector which may be used to connect the port 425 with a port that has a different shape than the circular cross section of the polarizer 410. An example of such an adaptor or connector is shown in FIGS. 8A and 8B and is discussed in detail in the examples which follow.

The polarizer 410 may include cap elements 430*a*, 430*b*, 430*c*, and 430*d*. The cap elements 430*a*, 430*b*, 430*d*, and 430*d* may be disposed over apertures that extend through the wall of the polarizer 410 to the axial void that extends along the length of the interior of the polarizer 410. The axial void may be a tubular-shaped space which extends from the feed horn 435 to the port 425. The apertures may be used to anchor the dielectric slab 420 as shown in the examples which follow. The cap elements 430*a*, 430*b*, 430*c*, and 430*d* cover these apertures to keep the internal walls of the polarizer 410 as sheer and smooth as possible to reduce or eliminate any electrical effects that would result from leaving the apertures open in the waveguide. The example implementation of integrated horn and polarizer 400 shown in FIGS. 4A, 4B, 4C, 4D, 4E, 4F, and 4G includes four such apertures, but other implementations may include a different number or configuration of such apertures. Furthermore, other implementations may not include the apertures through the wall of the polarizer 410 and instead may use other means for anchoring the dielectric slab 420. The cap elements 430*a*, 430*b*, 430*c*, and 430*d* may be configured to snap into or otherwise engage with a wall or lip which may be formed at least in part around each of the apertures in the wall of the polarizer 410. The cap elements 430*a*, 430*b*, 430*c*, and 430*d* may be formed from the same material as the polarizer 410. In other implementations, the cap elements 430*a*, 430*b*, 430*c*, and 430*d* may be implemented as a dovetail shape that may be slid into place rather than clipped into place.

Figure 4B:
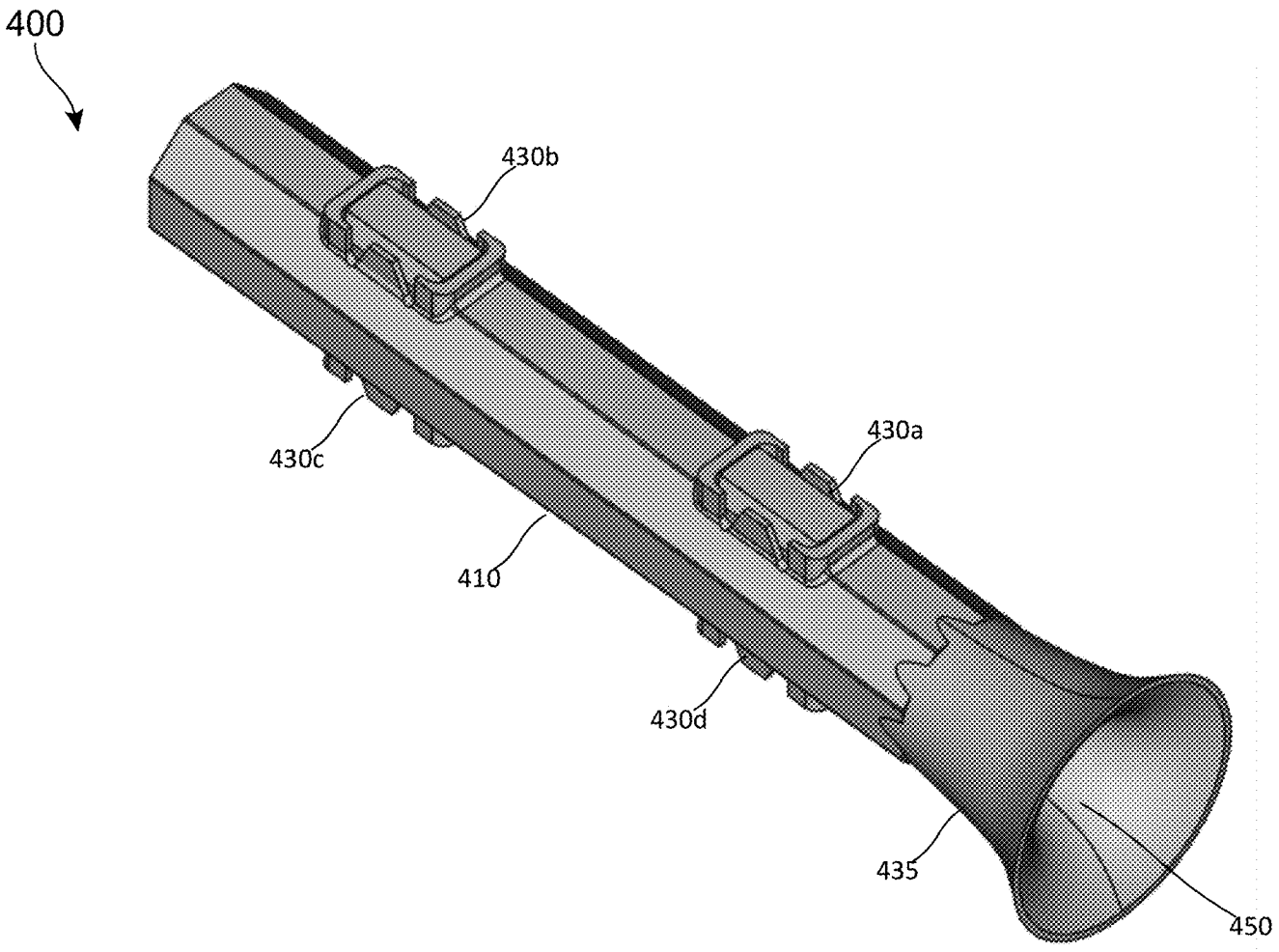

FIG. 4B shown a second view of the integrated horn and polarizer 400. The aperture 450 of the waveguide of the polarizer 410 is visible in FIG. 4B. FIG. 4D shows a view of the integrated horn and polarizer 400 from additional angles.

Figure 4C:
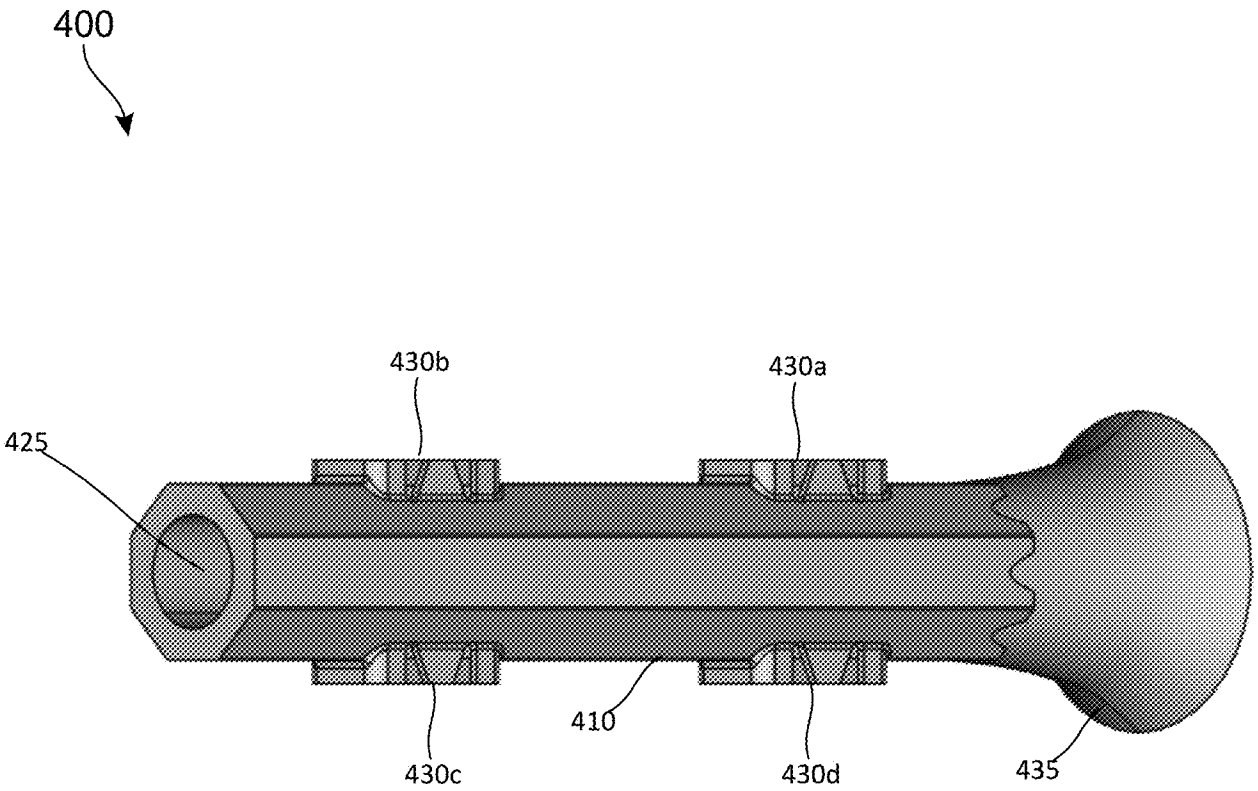
Figure 4D:
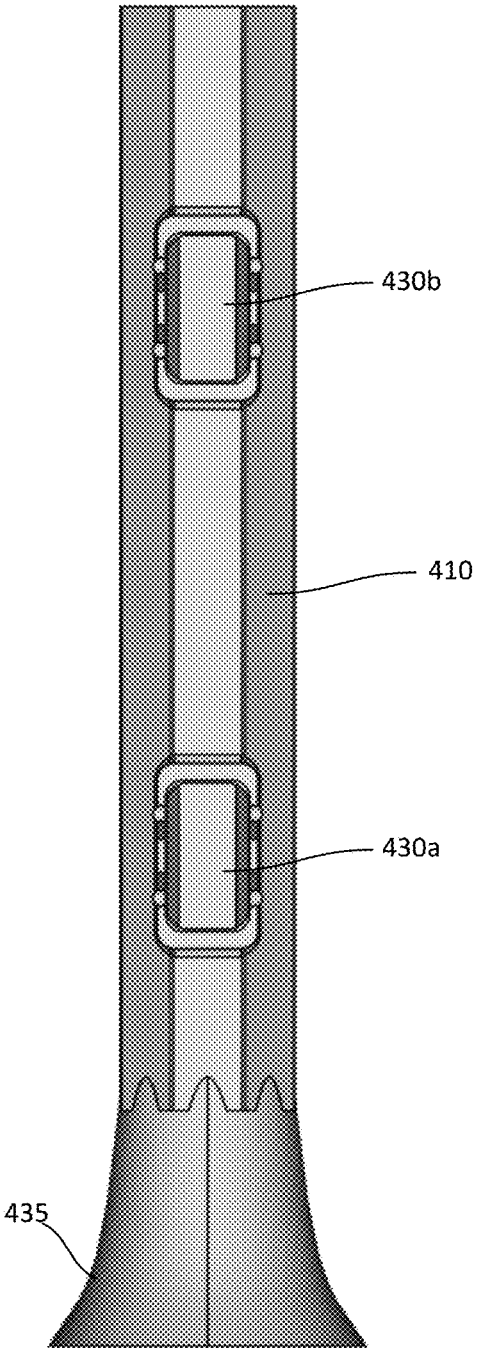

FIG. 4C shows a fourth view of the integrated horn and polarizer 400. The port 425 is visible in FIG. 4C. The port 425 may be used to connect the integrated horn and polarizer 400 to an OMT or other component of the communications device in which the integrated horn and polarizer 400 is being used. The port 425 of the integrated horn and polarizer 400 is round in this example implementation. However, the corresponding ports on the communications device may in some implementations be square or another non-round shape. In such instances, the integrated horn and polarizer 400 may include an integrated adaptor component, which will be discussed in the examples which follow. The adaptor component may be machined as an integral part of the integrated horn and polarizer 400.

Figure 4E:
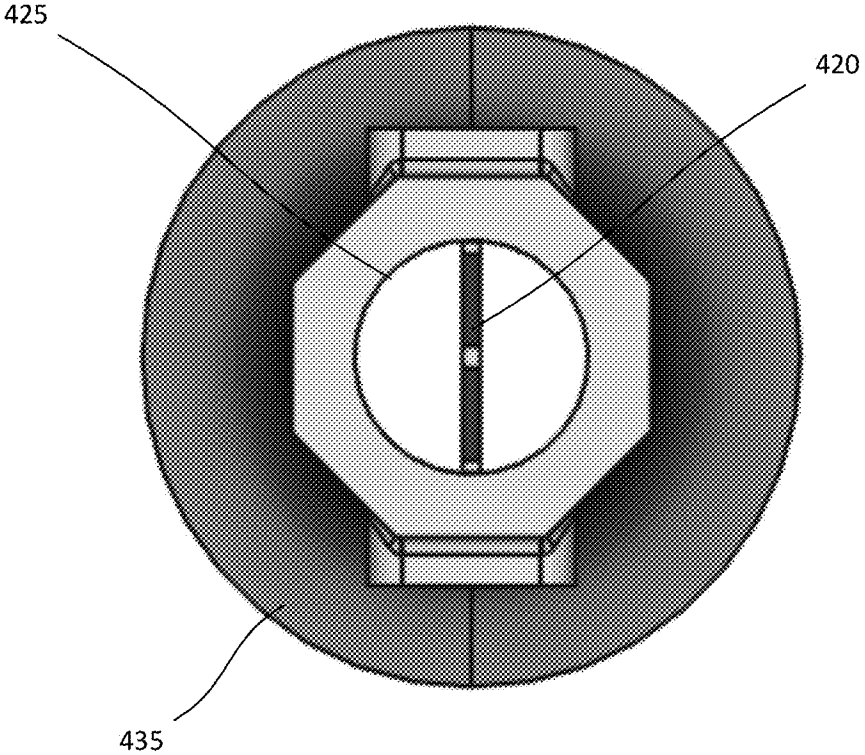

FIG. 4E shows a view of the integrated horn and polarizer 400 from the end of the integrated horn and polarizer 400 at which the port 425 is disposed. The dielectric slab 420 is visible through the port 425. The dielectric slab 420 may be inserted into the axial void of the integrated horn and polarizer 400 via the port 425.

Figure 4F:
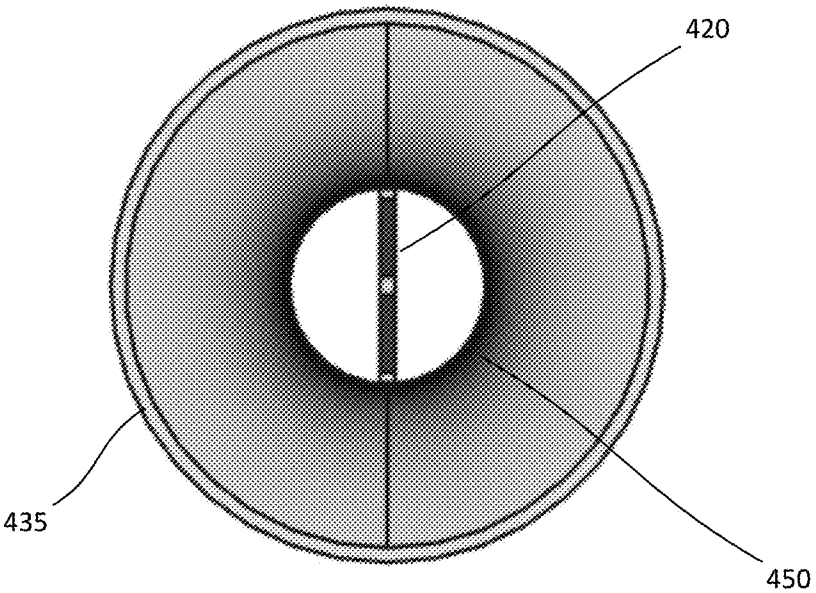

FIG. 4F shows a view of the integrated horn and polarizer 400 from the end of the integrated horn and polarizer 400 on which the feed horn 435 is disposed. The dielectric slab 420 can be seen through the aperture 450 of the feed horn 435. The dielectric slab 420 may be inserted into the axial void of the integrated horn and polarizer 400 via the aperture 450. The feet, tabs, or other features of the dielectric slab 420 may engage with one or more of the apertures to anchor the dielectric slab 420 in position within the integrated horn and polarizer 400. In some implementations, the dielectric slab 420 may be removably attached to the integrated horn and polarizer 400, and the dielectric slab 420 may be exchanged for a different dielectric slab 420 having a different length to fine tune the performance of the integrated horn and polarizer 400.

FIGS. 5A, 5B, 5C, 5D, 5E, and 5F are diagrams showing an example polarizer 510 of an integrated horn and polarizer 500 including grooves for mounting the dielectric slab 520 within the polarizer tube. The integrated horn and polarizer 500 may be used to implement the integrated horn and polarizers shown in the preceding examples. The integrated horn and polarizer 500 includes grooves 570*a*, 570*b*, 570*c*, and 570*d* formed in the wall of the polarizer 510 and the dielectric slab 520 may be inserted into the grooves in the internal wall of the polarizer 510. The integrated horn and polarizer 500 includes two pairs of grooves: (i) 570*a* and 570*c* and (ii) 570*b* and 570*d*. Each set of grooves may be used for receiving an edge of the dielectric slab 520 and for holding the dielectric slab 520 in place within the polarizer tube in a first position or a second position oriented 90 degrees from the first position. Other implementations may include additional sets of such grooves that permit the dielectric slab 520 to be inserted at additional angles. Yet other implementations may include a single set of such grooves for holding the dielectric slab 520 in position. The dielectric slab 520 may be inserted into the integrated horn and polarizer 500 via the port 525 or the feed horn 535 depending on the implementation.

The example implementation shown in FIGS. 5A, 5B, 5C, 5D, 5E, and 5F may be used in implementations where it not desirable to create apertures through the wall of the polarizer tube. The grooves may be formed in the walls of the polarizer 510 using an electrical discharge machining (EDM) technique or other machining technique capable of creating the grooves 570*a*, 570*b*, 570*c*, and 570*d*.

Figure 5A:
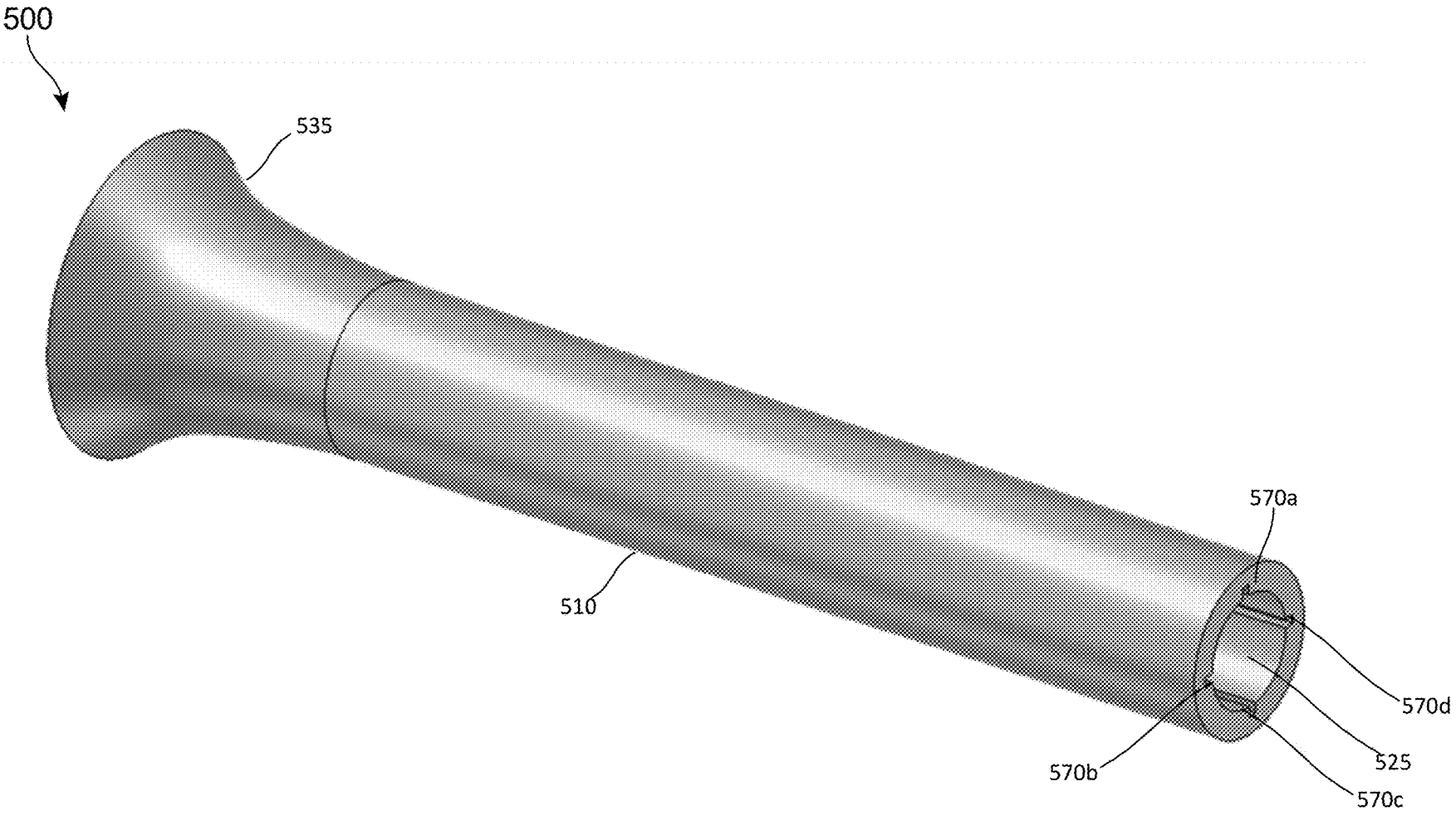
FIGS. 5A, 5B, 5C, 5D, 5E, and 5F are diagrams showing an example polarizer configuration including grooves for mounting the dielectric slab within the polarizer tube.
Figure 5B:
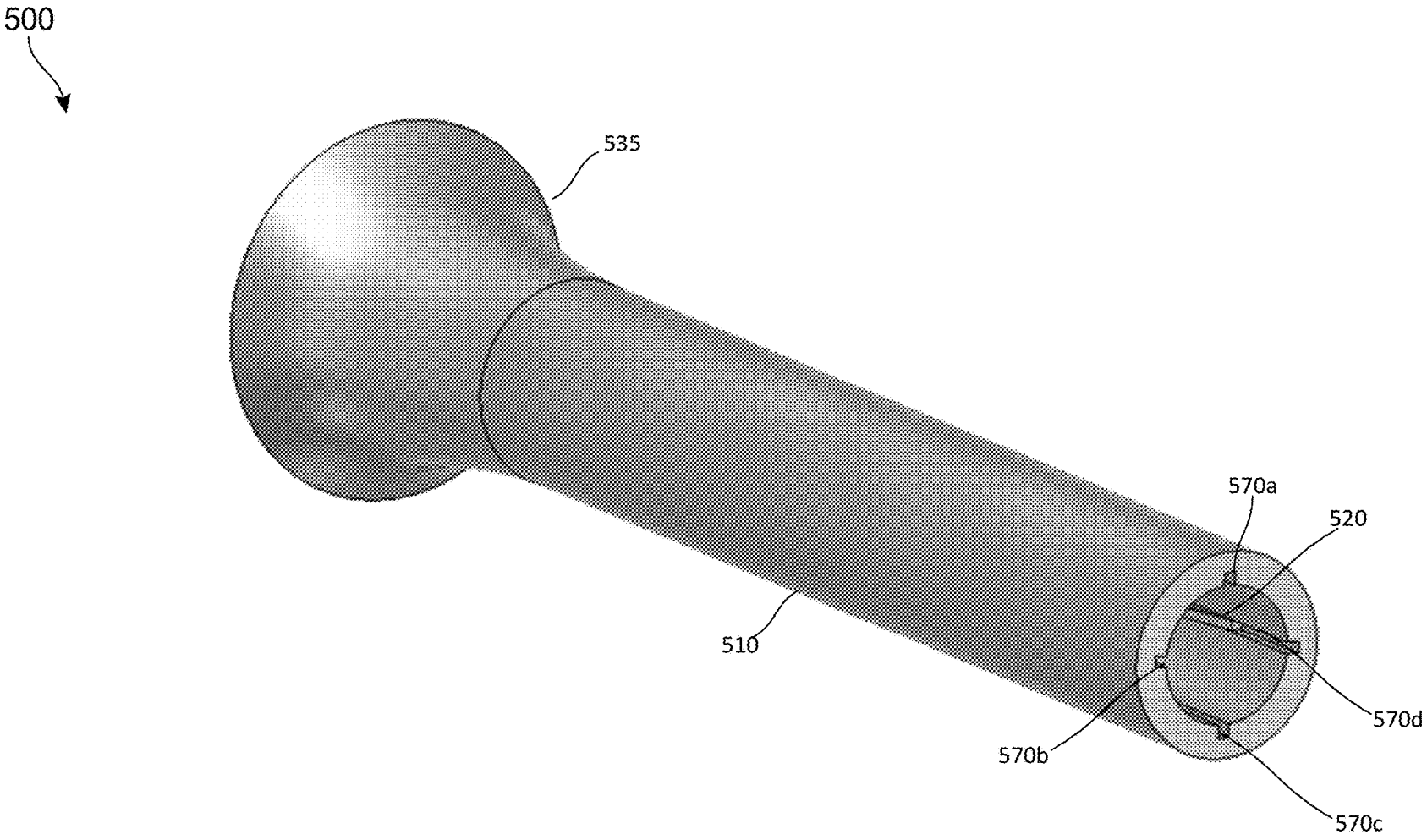
Figure 5C:
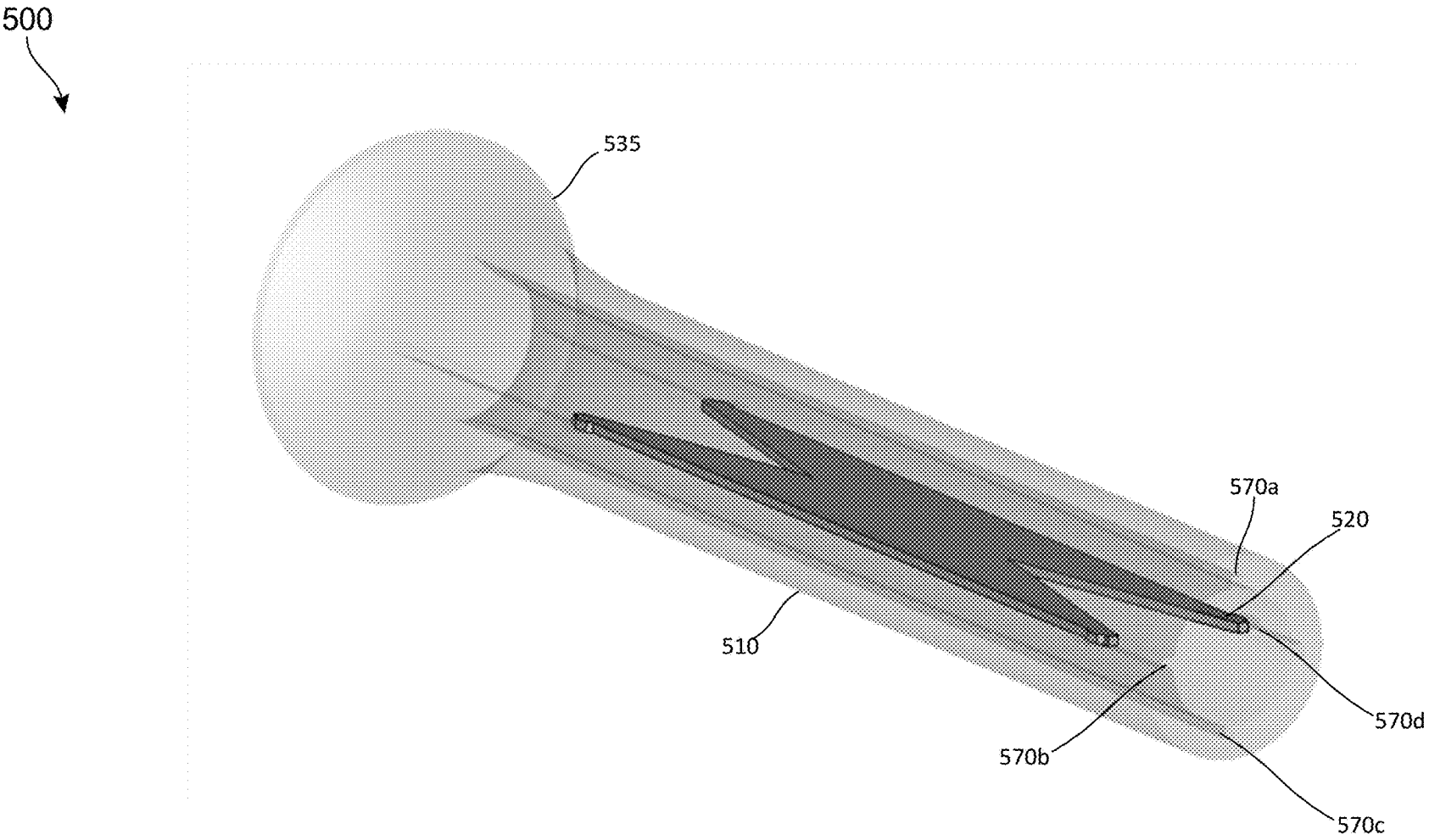
Figure 5D:
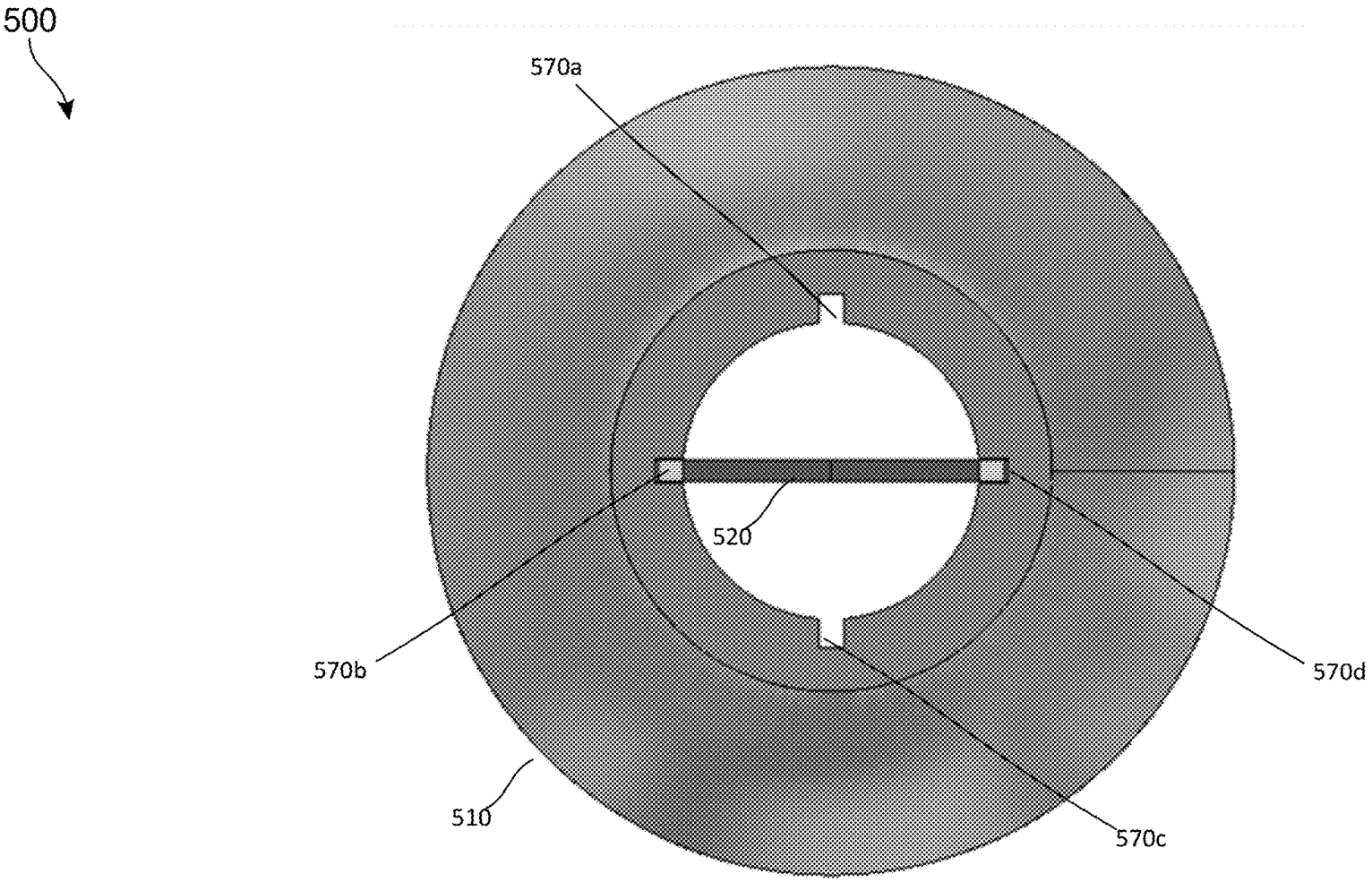
Figure 5E:
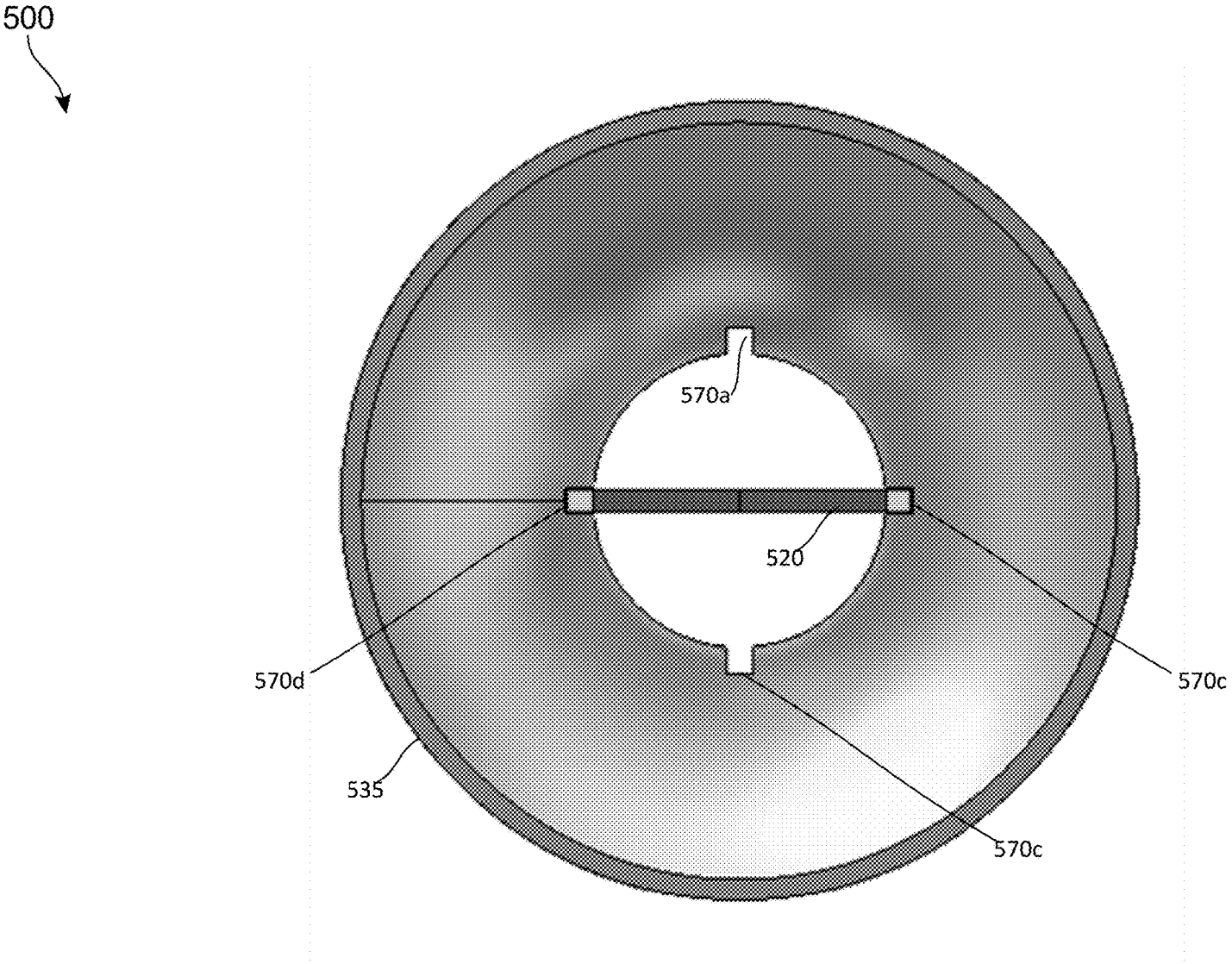
Figure 5F:
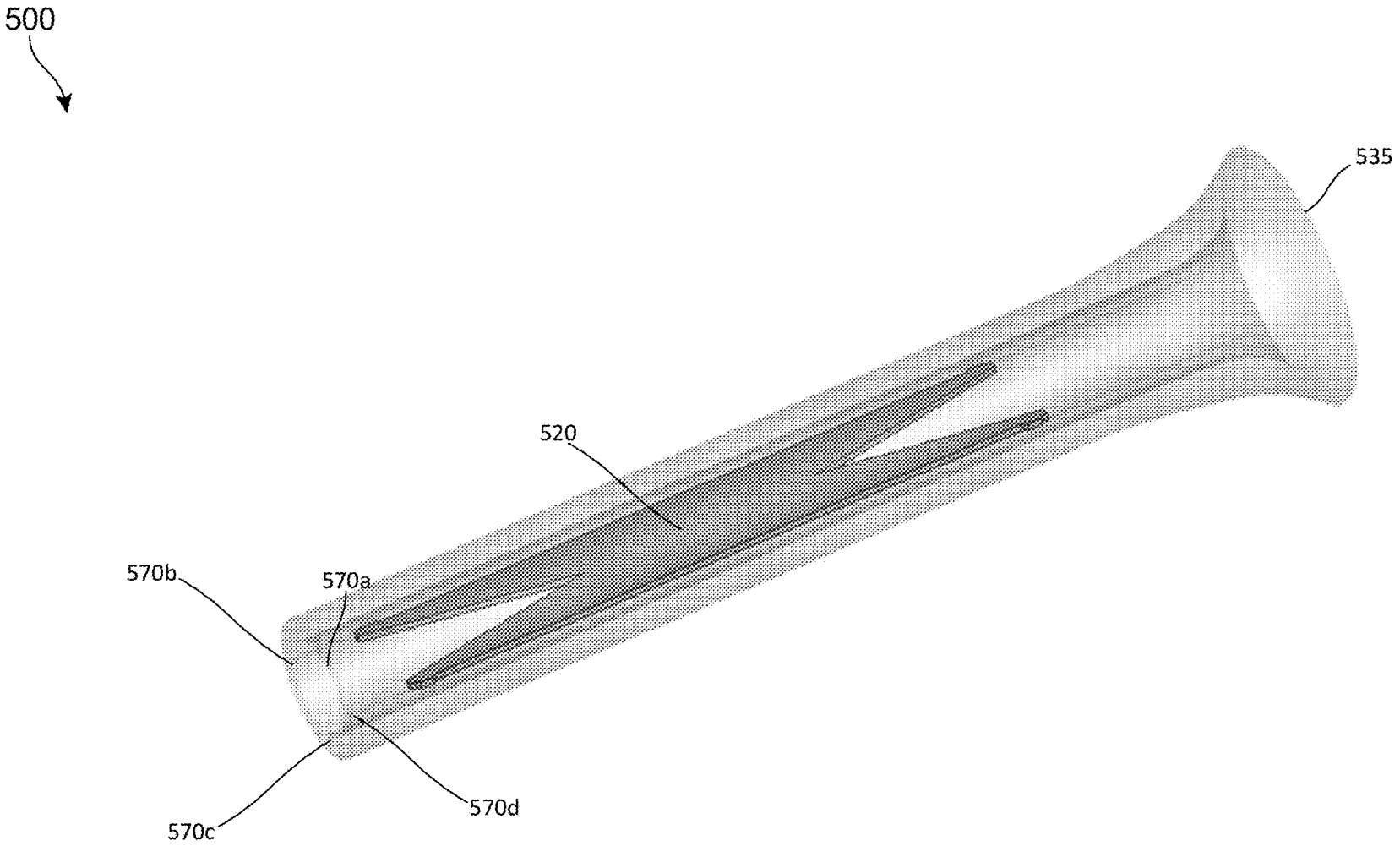

FIGS. 5C and 5F are diagrams providing a semi-transparent view of the integrated horn and polarizer 500 to show the internal structure details of the integrated horn and polarizer 500. FIG. 5E shows a view of the integrated horn and polarizer 500 from the end of the integrated horn and polarizer 500 on which the feed horn 435 is disposed. FIG. 5F shows a view of the integrated horn and polarizer 500 from the end of the integrated horn and polarizer 500 at which the port 525 is disposed. The dielectric slab 520 can be seen positioned within the interior of the polarizer 510 in FIGS. 5C and 5F.

Figure 6A:
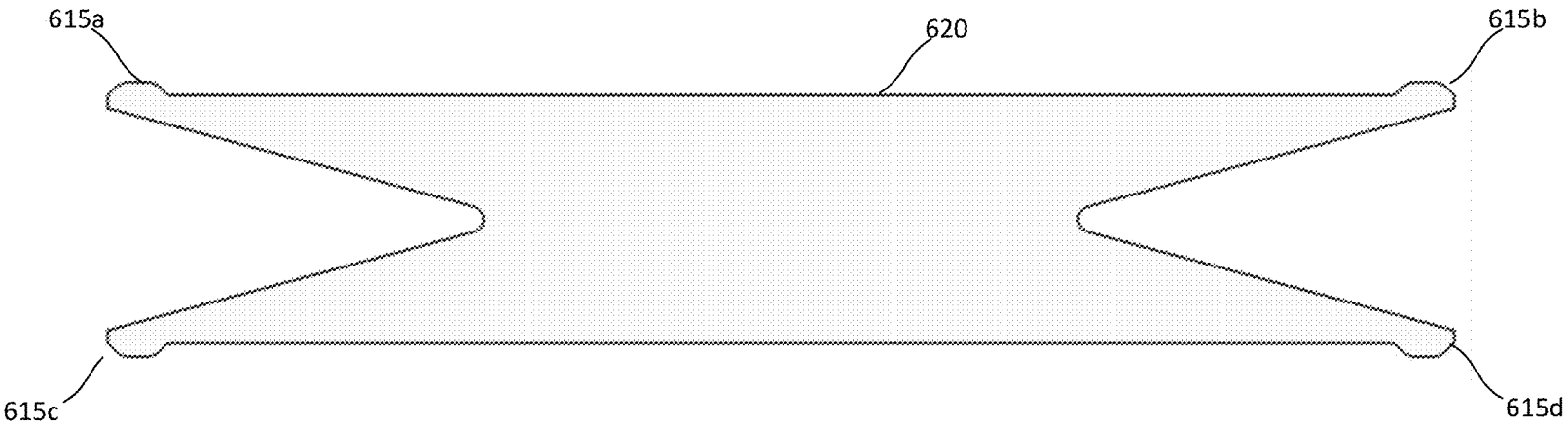
FIG. 6A is a diagram showing details of an example dielectric slab that includes tabs for engaging apertures formed into the polarizer tube for mounting the dielectric slab within the polarizer tube of integrated feed horn and polarizer.
Figure 6B:
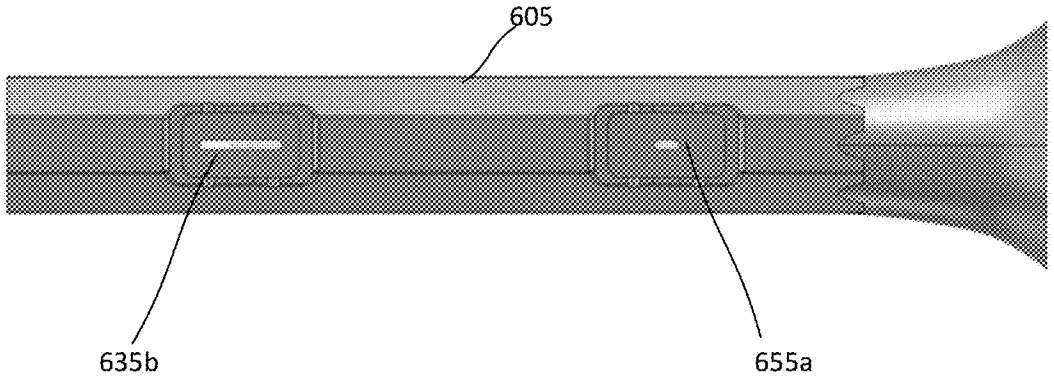
FIG. 6B is a diagram showing an example configuration of apertures formed into the polarizer tube into which the tabs of the dielectric slab shown in FIG. 6A may be inserted.
Figure 6C:
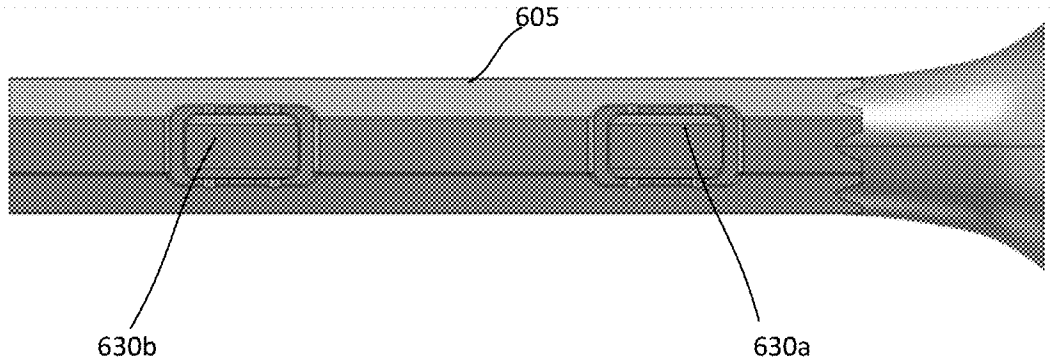
FIG. 6C is a diagram the example configuration of the apertures of FIG. 6B with the apertures having caps placed over the apertures.

FIG. 6A is a diagram showing details of an example dielectric slab 620 that includes tabs 615*a*, 615*b*, 615*c*, and 615*d* for engaging apertures formed into the polarizer tube for mounting the dielectric slab 620 within the polarizer tube. FIGS. 6B and 6C show examples of two configurations of the apertures that may be formed in the wall of the polarizer tube of the integrated horn and polarizer 605.

Figure 6D:
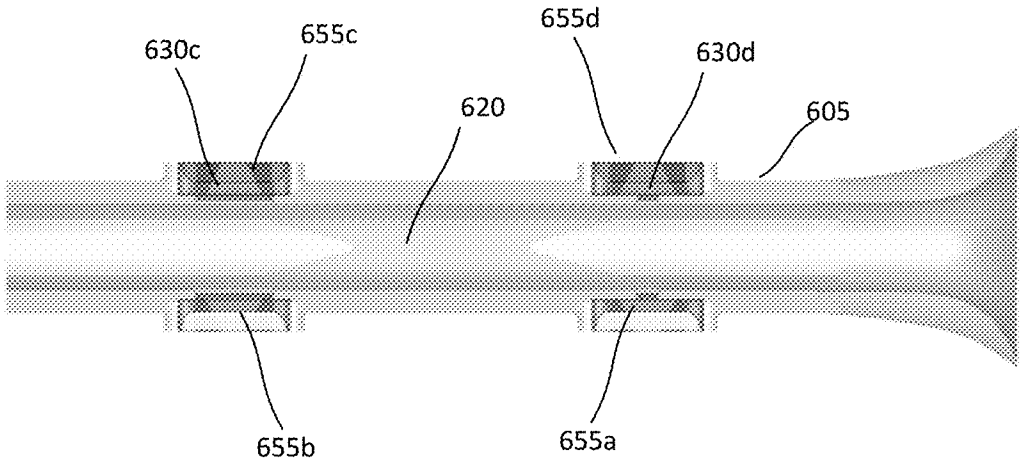
FIG. 6D is a diagram showing the polarizer tube of the integrated feed horn and polarizer shown in FIGS. 6B and 6C as partially transparent so that the position of the dielectric slab within the polarizer tube is visible.

FIG. 6B is a diagram showing an example configuration of apertures formed into the polarizer tube into which the tabs 615*a*, 615*b*, 615*c*, and 615*d* of the dielectric slab 620 shown in FIG. 6A may be inserted. FIG. 6B shows a pair of apertures 655*a* and 655*b* that may be formed along the central axis of one wall of the polarizer tube of the integrated horn and polarizer 605. The pair of apertures 655*a* and 655*b* may be aligned with a substantially similar apertures 630*c* and 630*d* (shown in FIG. 6D) formed along the central axis of the opposite wall of the polarizer tube of the integrated horn and polarizer 605. The apertures 655*a*, 655*b*, 655*c*, and 655*d* may be covered with cap elements 630*a*, 630*b*, 630*c*, and 630*d* shown in FIGS. 6C and 6D to cover the apertures to keep the walls of the integrated feed horn and polarizer 605 as sheer as possible to reduce or eliminate any electrical effects that would result from leaving the apertures open. The cap elements may be similar to those shown in FIGS. 4A-4G or the examples which follow in FIGS. 7A-7C.

The apertures 655*a*, 655*b*, 655*c*, and 655*d* may be configured to accommodate a tab of the dielectric slab 620, such as the tabs 615*a*, 615*b*, 615*c*, and 615*d* of the dielectric slab 620 shown in FIG. 6A. The tabs 615*a*, 615*b*, 615*c*, and 615*d* may allow the dielectric slab 620 to be removably snapped into place within the integrated horn and polarizer 605 by inserting the dielectric slab 620 through either end of the integrated horn and polarizer 605. In some implementations, the apertures 655*a*, 655*b*, 655*c*, and 655*d* may each be substantially the same size and/or shape and are configured to receive a dielectric slab 620 of a fixed length. However, in other implementations, the at least some of the pairs of apertures aligned with each other on opposite walls of the polarizer tube of the integrated horn and polarizer 605 may be formed as elongated openings to accommodate tabs of dielectric slabs 620 of different lengths.

Figure 6E:
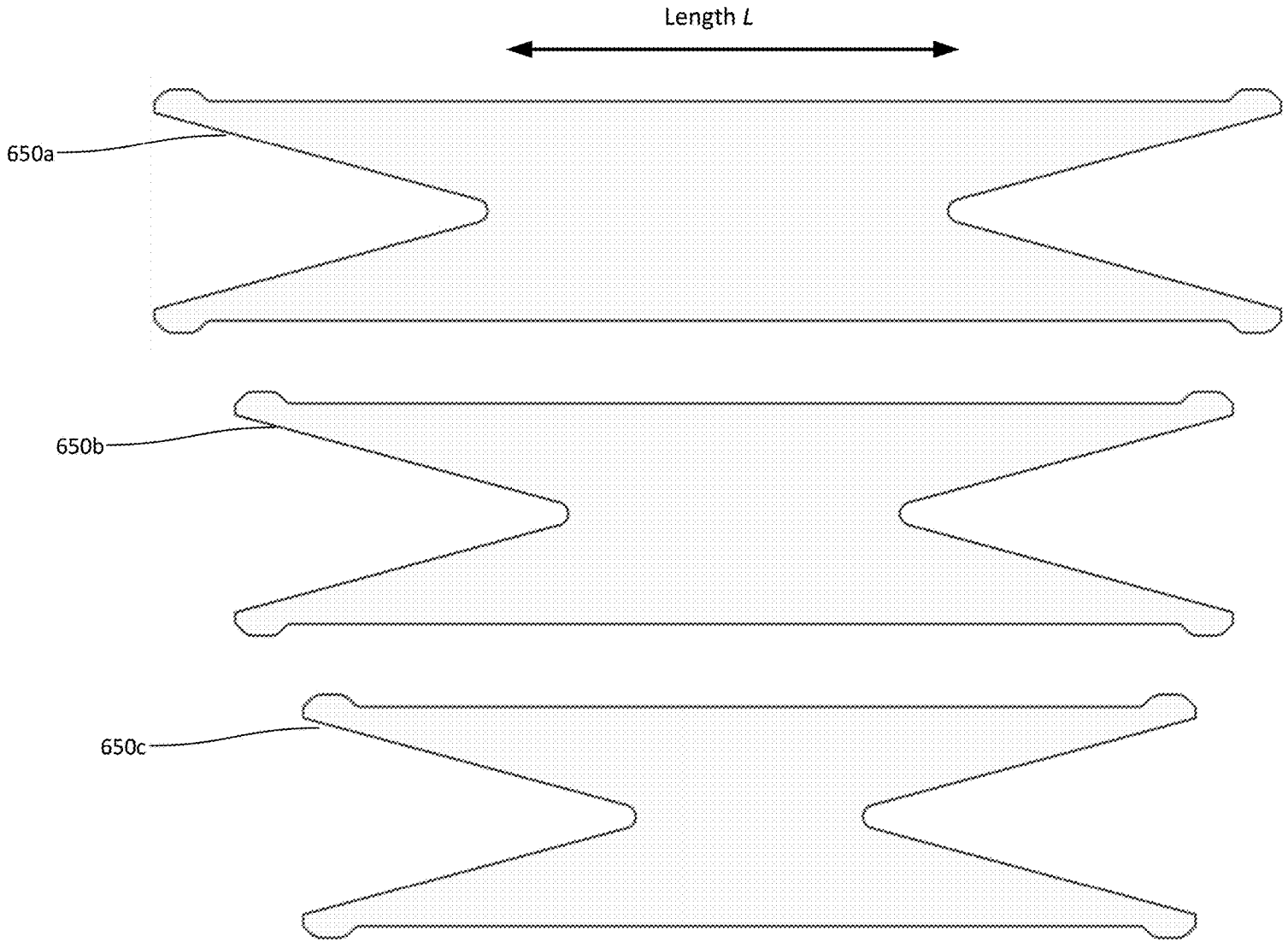
FIG. 6E is a diagram showing an example of dielectric slabs having different sizes that may be used to fine tune the performance of the integrated feed horn and polarizer.

In the example shown in FIG. 6B, the second aperture 630*b* forms an elongated opening so that the apertures 630*a* and 630*b* may accommodate the tabs of dielectric slabs 620 of different lengths. The implementation shown in FIG. 6B may accommodate dielectric slabs having a different length, such as the dielectric slabs 650*a*, 650*b*, and 650*c* shown in FIG. 6E. The dielectric slabs 650*a*, 650*b*, and 650*c* may each have the same configuration except for the length L of each of the dielectric slabs varies. The thickness of the vanes, angles of the vanes, and other features have been kept the same for each of the dielectric slabs 650*a*, 650*b*, and 650*c*. While the example shown in FIG. 6E shows dielectric slabs of three different lengths, other implementations may include a different number of dielectric slabs having different lengths. In some implementation, the set of dielectric slabs may include a dielectric slab having a specified "optimal" length that is expected to provide the best results when testing the performance of the integrated horn and polarizer 605. The set of dielectric slabs may include at least one dielectric slab that is shorter than the optimal length and at least one vane that is longer than the optimal length. The performance of the integrated feed horn and polarizer 605 may be tested using a standardized set of tests used to test each of the integrated feed horn and polarizers being produced for a particular application. Based on the performance of the integrated feed horn and polarizer 605 during the testing, a determination may be made to replace the dielectric slab 620 with another dielectric slabs having a different length. The length selected may be based on the previous benchmark testing to determine the impact of replacing the dielectric slab 620 with a longer or shorter dielectric slab. The length selected to correct a particular integrated feed horn and polarizer 605 may depend upon the tolerances associated with the particular implementation of the integrated feed horn and polarizer 605.

Figure 10:
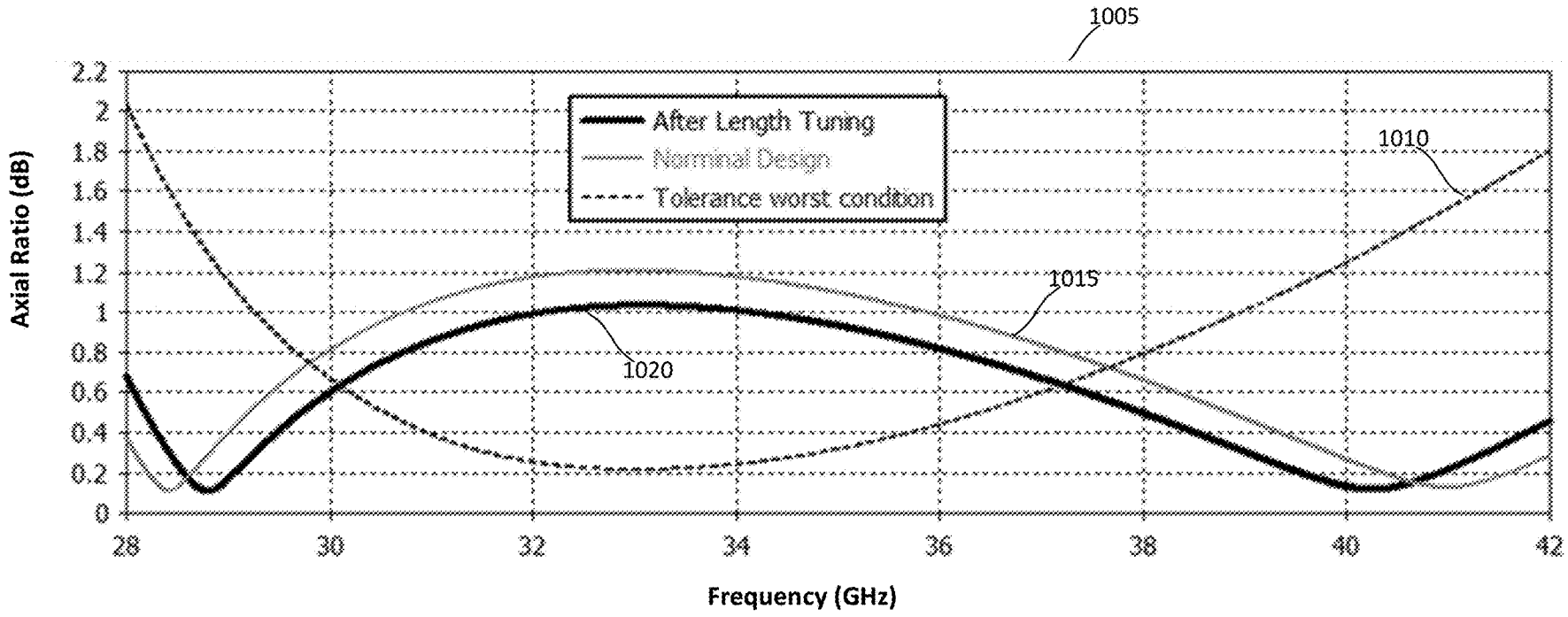
FIG. 10 shows an example of testing the axial ratio of the antenna using the integrated feed horn and polarizer.

FIG. 10 shows an example of testing the axial ratio of an antenna using the integrated feed horn and polarizer 605. The chart 1005 includes three plots 1010, 1015, and 1020. Manufacturing tolerances for the integrated feed horn and polarizer 605 may negatively impact the performance of the device. The plot 1010 shows the performance under worst case tolerance conditions. The plot 1015 shows improved performance under nominal conditions. The plot 1020 shows further improved performance that may be provided by the length tuning techniques discussed herein in which the length of the dielectric slab 620 may be increased or decreased to adjust the performance of the integrated feed horn and polarizer 605.

Figure 7A:
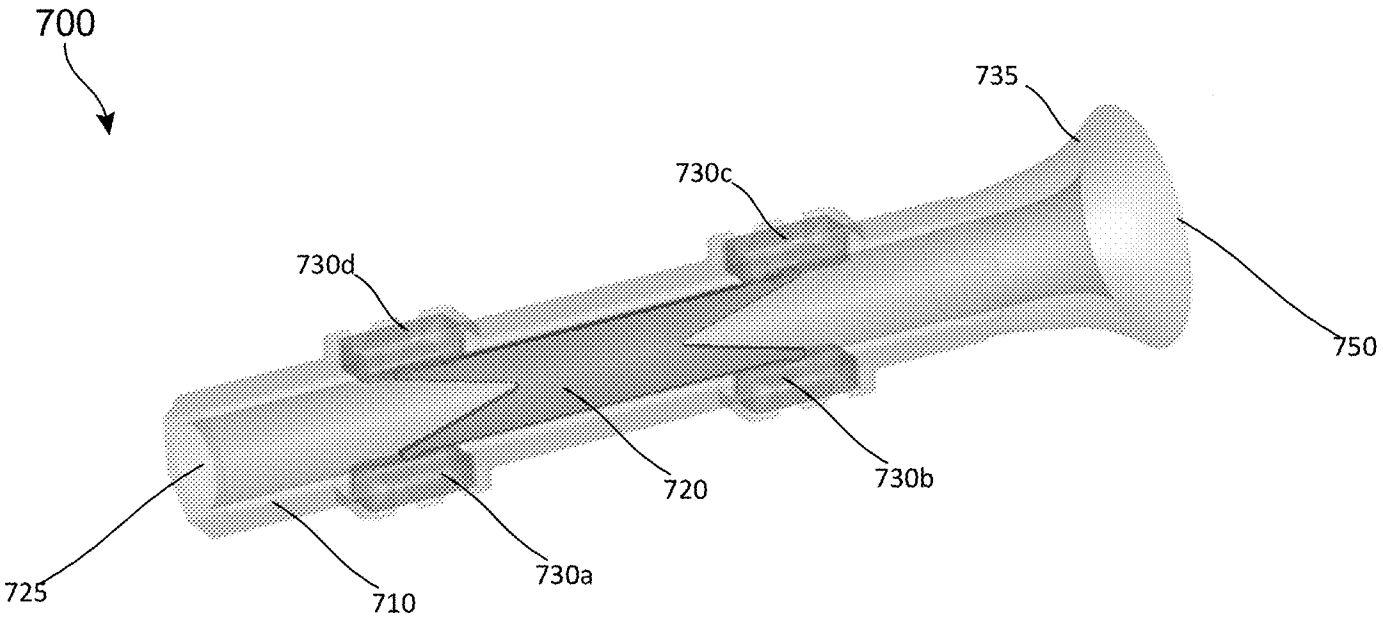
FIGS. 7A, 7B, and 7C are diagrams of an integrated feed horn and polarizer that show means for capping apertures formed in the polarizer tube of an integrated feed horn and polarizer for mounting the dielectric slab polarizer within the polarizer tube.
Figure 7B:
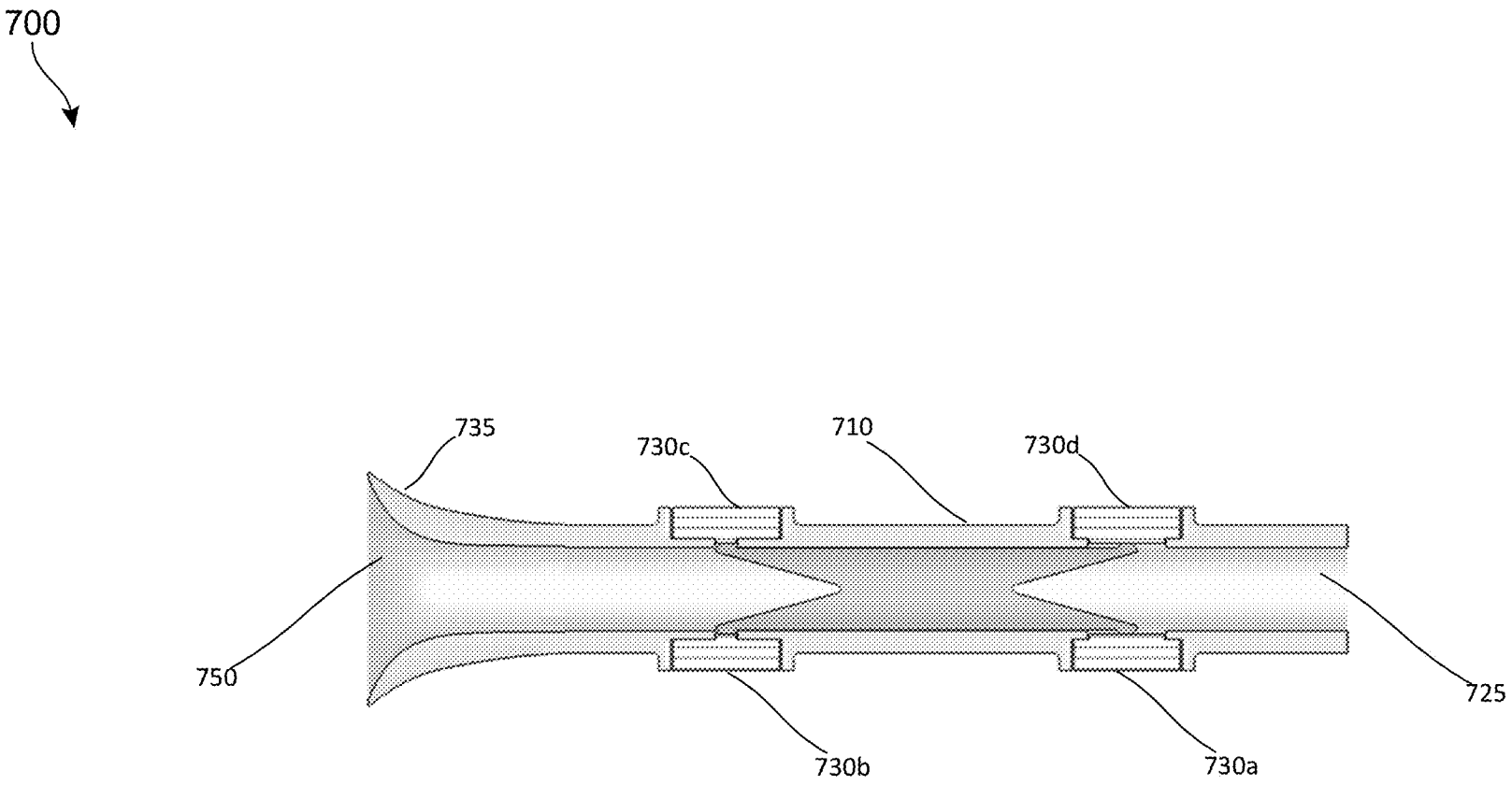
Figure 7C:
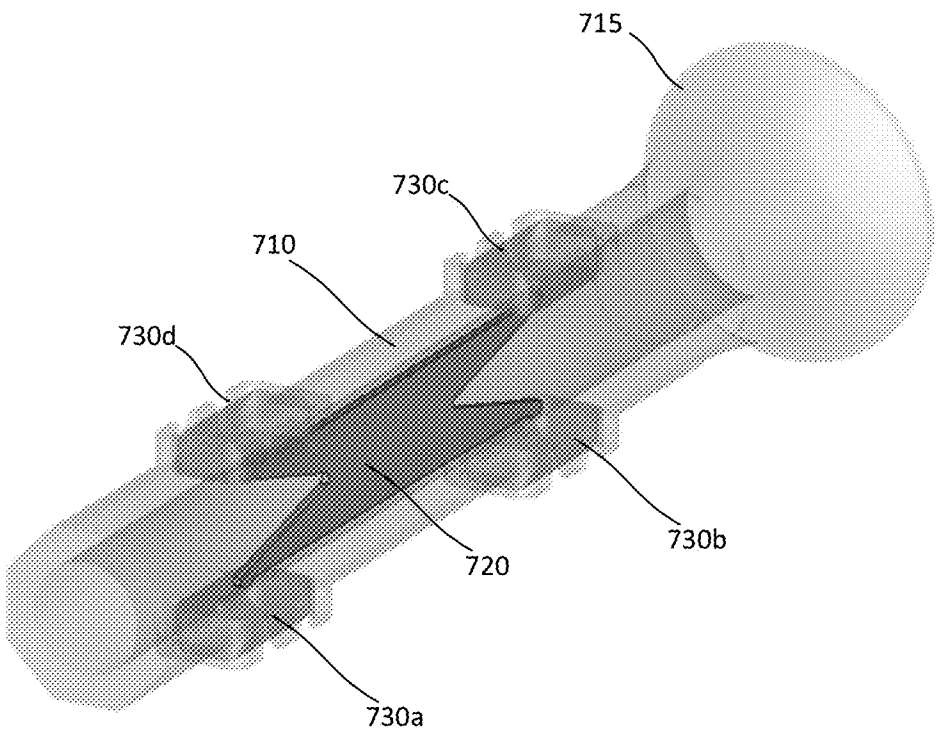

FIG. 7A is a diagram of an integrated feed horn and polarizer 700 that includes apertures formed through the walls of the polarizer tube to facilitate attaching the dielectric slab 720 within the integrated feed horn and polarizer 700. FIGS. 7B and 7C show views of the integrated feed horn and polarizer 700. The integrated feed horn and polarizer 700 is shown as semi-transparent to show how the dielectric slab 720 may be disposed within the polarizer 710 of the integrated feed horn and polarizer 700. Tabs on each of the vanes of the dielectric slab 720 may engage with one of the apertures 730*a*, 730*b*, 730*c*, and 730*d* to anchor the dielectric slab 720 in position within the integrated horn and polarizer 700. The dielectric slab 720 may be removably attached to the integrated horn and polarizer 700, and the dielectric slab 720 may be exchanged for a different dielectric slab 720 having a different length to fine tune the performance of the integrated horn and polarizer 700. The dielectric slab 720 may be inserted into the polarizer 710 via the port 725 or via the aperture 750 of the feed horn 735.

Figure 7D:
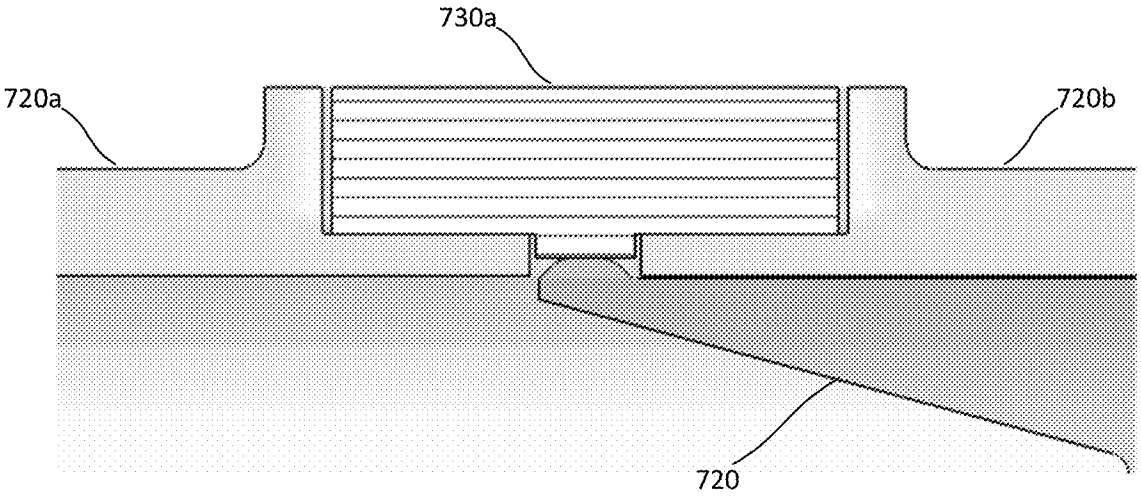
FIG. 7D is a diagram of a cross section of the wall of the polarizer tube of the integrated feed horn and polarizer that shows a tab of the dielectric slab engaging with an aperture formed in the wall of the polarizer tube and a cap covering the aperture.

The apertures have been capped using cap elements 730*a*, 730*b*, 730*c*, and 730*d*. The cap elements 730*a*, 730*b*, 730*c*, and 730*d* cover the apertures to keep the walls of the integrated feed horn and polarizer 700 as sheer and smooth as possible to reduce or eliminate any electrical effects that would result from leaving the apertures open. FIG. 7D is a diagram of a cross section of the wall of the polarizer tube of the integrated feed horn and polarizer 700 that shows a tab of the dielectric slab 720 engaging with an aperture formed in the wall of the polarizer tube and the cap 730*a* covering the aperture. The cap 730*a* in this example may be configured to fit into raised walls formed around the apertures, as shown for example in FIGS. 4A-4D.

FIGS. 8A and 8B are diagrams showing an example of an integrated feed horn and polarizer 800 that includes an adaptor or connector 860 for coupling the integrated feed horn and polarizer to a port of a device, such as but not limited to an OMT, where the port of the device has a different shape than the port 425 shown in the preceding examples. The connector 860 is formed at the end of the polarizer 810 opposite the feed horn 835 of the integrated feed horn and polarizer 800. The connector 860 may be machined as part of the integrated horn and polarizer 800 to avoid the introduction of an interface between the integrated horn and polarizer 800 and the connector 860 which might degrade RF performance and/or result in RF leakage. The connector 860 allows the integrated feed horn and polarizer examples shown in the preceding examples with devices that have ports that are not circular.

FIG. 8B shows a sectional view of the integrated feed horn and polarizer 800 in which the internal structure of the connector 860 is visible. The dielectric slab 820 is also visible. The internal structure of the connector 860 includes transitional elements 870 that gradually transition from the circular-shaped cross section of the polarizer 810 to the square shape of the port 865.

Figure 9:
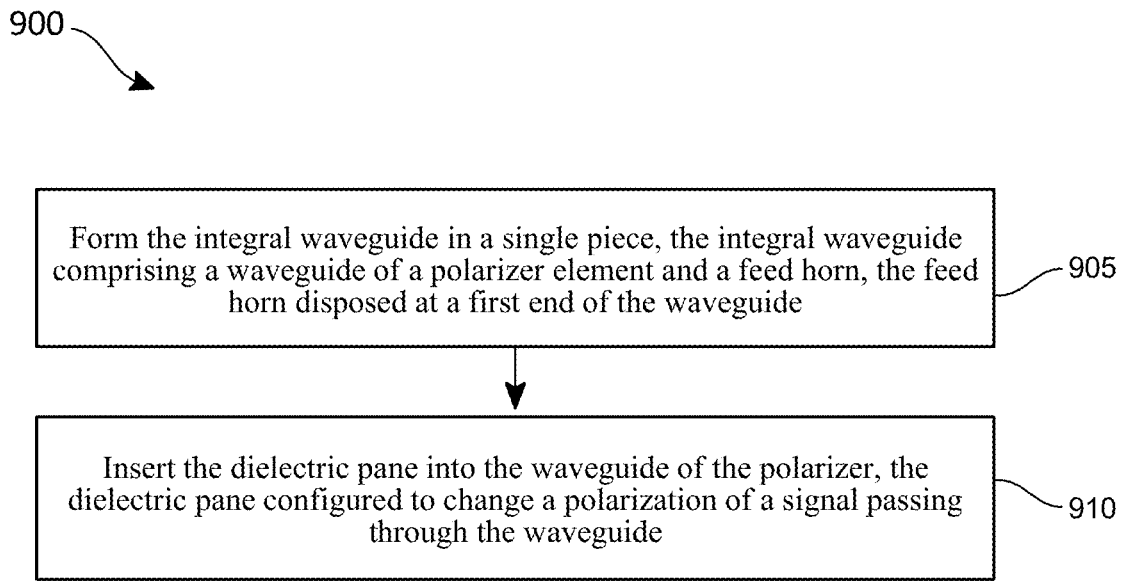
FIG. 9 is flow diagram of a process for manufacturing an integral waveguide.

FIG. 9 is a flow diagram of a process 900 for manufacturing an integrated feed horn and polarizer. The process 900 may be used to manufacture the integrated feed horn and polarizer shown in the preceding examples.

The process 900 may include an operation 905 of forming the integral waveguide in a single piece. The integral waveguide includes a waveguide of a polarizer element and a feed horn, and the feed horn is disposed at a first end of the waveguide.

The process 900 may include an operation 910 of inserting the dielectric slab into the waveguide of the polarizer. The dielectric slab is configured to change a polarization of a signal passing through the waveguide. The dielectric slab may be inserted into and affixed to the waveguide using the techniques discussed in the preceding examples.

While various embodiments have been described, the description is intended to be exemplary, rather than limiting, and it is understood that many more embodiments and implementations are possible that are within the scope of the embodiments. Although many possible combinations of features are shown in the accompanying figures and discussed in this detailed description, many other combinations of the disclosed features are possible. Any feature of any embodiment may be used in combination with or substituted for any other feature or element in any other embodiment unless specifically restricted. Therefore, it will be understood that any of the features shown and/or discussed in the present disclosure may be implemented together in any suitable combination. Accordingly, the embodiments are not to be restricted except in light of the attached claims and their equivalents. Also, various modifications and changes may be made within the scope of the attached claims.

While the foregoing has described what are considered to be the best mode and/or other examples, it is understood that various modifications may be made therein and that the subject matter disclosed herein may be implemented in various forms and examples, and that the teachings may be applied in numerous applications, only some of which have been described herein. It is intended by the following claims to claim any and all applications, modifications and variations that fall within the true scope of the present teachings.

Unless otherwise stated, all measurements, values, ratings, positions, magnitudes, sizes, and other specifications that are set forth in this specification, including in the claims that follow, are approximate, not exact. They are intended to have a reasonable range that is consistent with the functions to which they relate and with what is customary in the art to which they pertain.

The scope of protection is limited solely by the claims that now follow. That scope is intended and should be interpreted to be as broad as is consistent with the ordinary meaning of the language that is used in the claims when interpreted in light of this specification and the prosecution history that follows and to encompass all structural and functional equivalents. Notwithstanding, none of the claims are intended to embrace subject matter that fails to satisfy the requirement of Sections 101, 102, or 103 of the Patent Act, nor should they be interpreted in such a way. Any unintended embracement of such subject matter is hereby disclaimed.

Except as stated immediately above, nothing that has been stated or illustrated is intended or should be interpreted to cause a dedication of any component, step, feature, object, benefit, advantage, or equivalent to the public, regardless of whether it is or is not recited in the claims.

It will be understood that the terms and expressions used herein have the ordinary meaning as is accorded to such terms and expressions with respect to their corresponding respective areas of inquiry and study except where specific meanings have otherwise been set forth herein. Relational terms such as first and second and the like may be used solely to distinguish one entity or action from another without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "a" or "an" does not, without further constraints, preclude the existence of additional identical elements in the process, method, article, or apparatus that comprises the element.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various examples for the purpose of streamlining the disclosure. This method of disclosure is not to be interpreted as reflecting an intention that the claims require more features than are expressly recited in each claim. Rather, as the following claims reflect, inventive subject matter lies in less than all features of a single disclosed example. Thus, the following claims are hereby incorporated into the Detailed Description, with each claim standing on its own as a separately claimed subject matter.

What is claimed is:

1. An integral waveguide device comprising:

a polarizer component comprising a waveguide and a dielectric slab, the dielectric slab configured to change a polarization of a signal passing through the waveguide; and a feed horn for conveying signals between the waveguide and a parabolic antenna, wherein:

the waveguide of the polarizer component and the feed horn are formed manufactured as an integral component with the feed horn disposed at a first end of the waveguide, the dielectric slab is configured to be inserted into an axial void that traverses a length of the waveguide, the waveguide includes a plurality of first apertures in a wall of the waveguide defining a first position surrounding the axial void and a plurality of second apertures in the wall of the waveguide defining a second position surrounding the axial void, and the dielectric slab includes a plurality of tabs configured to engage with the plurality of first apertures or the plurality of second apertures respectively when the dielectric slab is placed in the first position or the second position to hold the dielectric slab within the waveguide.

2. The integral waveguide device of claim 1, wherein the waveguide of the polarizer component and the feed horn are machined as a single piece.

3. The integral waveguide device of claim 1, wherein the waveguide of the polarizer component and the feed horn are extruded as a single piece.

4. The integral waveguide device of claim 1, wherein the plurality of first apertures and the plurality of second apertures are configured to enable the waveguide to accommodate dielectric slabs having a plurality of lengths.

5. The integral waveguide device of claim 1, wherein the waveguide includes a plurality of removable cap elements configured to engage a wall of the polarizer component to cover an opening of the plurality of first apertures and the plurality of second apertures on an exterior side of the wall of the waveguide.

6. The integral waveguide device of claim 1 wherein:

the axial void has a circular cross section, the waveguide including a pair of slots disposed on opposite sides of an interior surface of a wall forming the axial void, and a first edge of the dielectric slab being inserted in a first slot of the pair of slots and a second edge of the dielectric slab being inserted into a second slot of the pair of slots to hold the dielectric slab in position within the waveguide.

7. The integral waveguide device of claim 1, wherein one or more performance characteristics of the integral waveguide device are optimizable by altering a length of the dielectric slab.

8. The integral waveguide device of claim 1, further comprising a connector component integral with the waveguide at a second end of the waveguide opposite the first end of the waveguide, the connector component being configured to connect the waveguide to a port having a cross sectional shape that is different from a cross sectional shape of the waveguide, the connector component comprising transitional elements that gradually transition a cross section of the connector component from the cross sectional shape of the port to the cross sectional shape of the waveguide.

9. The integral waveguide device of claim 1, wherein the integral waveguide device is installed in a very small aperture terminal (VSAT), and wherein the parabolic antenna is an element of the VSAT.

10. A method for manufacturing an integral waveguide device comprising:

forming the integral waveguide device in a single piece, the integral waveguide device comprising a waveguide of a polarizer component and a feed horn, the feed horn disposed at a first end of the waveguide; and inserting a dielectric slab into the waveguide of the polarizer component, the dielectric slab is configured to change a polarization of a signal passing through the waveguide; wherein:

the dielectric slab is configured to be inserted into an axial void that traverses a length of the waveguide, the waveguide includes a plurality of first apertures in a wall of the waveguide defining a first position surrounding the axial void and a plurality of second apertures in the wall of the waveguide defining a second position surrounding the axial void, and the dielectric slab includes a plurality of tabs configured to engage with the plurality of first apertures or the plurality of second apertures respectively when the dielectric slab is placed in the first position or the second position to hold the dielectric slab within the waveguide.

11. The method of claim 10, wherein forming the integral waveguide further comprises machining the waveguide of the polarizer component and the feed horn as a single piece.

12. The method of claim 10, wherein forming the integral waveguide further comprises extruding the waveguide of the polarizer component and the feed horn as a single piece using a lathe.

13. The method of claim 10, wherein inserting the dielectric slab into the waveguide of the polarizer component further comprises inserting the dielectric slab into an axial void that traverses a length of the waveguide.

14. The method of claim 13, further comprising forming a plurality of apertures through a wall of the waveguide surrounding the axial void, wherein inserting the dielectric slab into the waveguide further comprises inserting the dielectric slab such that a plurality of tabs of the dielectric slab engage with the plurality of apertures to hold the dielectric slab in position within the waveguide.

15. The method of claim 14, further comprising:

covering an opening of the plurality of first apertures and the plurality of second apertures on an exterior side of the wall of the waveguide with respective one of a plurality of removable cap elements configured to engage a wall of the polarizer component.

16. The method of claim 13, wherein:

the axial void has a circular cross section, and the waveguide including a pair of slots disposed on opposite sides of an interior surface of a wall forming the axial void, the method further comprising:

inserting a first edge of the dielectric slab into a first slot of the pair of slots; and inserting a second edge of the dielectric slab into a second slot of the pair of slots to hold the dielectric slab in position within the waveguide.

17. The method of claim 10, further comprising:

altering a length of the dielectric slab to optimize one or more performance characteristics of the integral waveguide device.

18. The method of claim 10, further comprising:

forming a connector component integral with the waveguide at a second end of the waveguide opposite the first end of the waveguide, the connector component being configured to connect the waveguide to a port having a cross sectional shape that is different from a cross sectional shape of the waveguide, the connector component comprising transitional elements that gradually transition a cross section of the connector component from the cross sectional shape of the port to the cross sectional shape of the waveguide.

19. The method of claim 10, further comprising:

installing the integral waveguide in a very small aperture terminal (VSAT).

* * * * *